US006775506B2

(12) United States Patent
Endoh et al.

(10) Patent No.: US 6,775,506 B2
(45) Date of Patent: Aug. 10, 2004

(54) METHOD AND APPARATUS FOR IMAGE DEVELOPING CAPABLE OF EFFECTIVELY FORMING AN EVEN DEVELOPMENT AGENT LAYER

(75) Inventors: Shuuichi Endoh, Kanagawa-Ken (JP); Osamu Endou, Kanagawa-Ken (JP); Nobuhiko Umezawa, Kanagawa-Ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/875,034

(22) Filed: Jun. 7, 2001

(65) Prior Publication Data

US 2002/0012553 A1 Jan. 31, 2002

(30) Foreign Application Priority Data

Jun. 7, 2000 (JP) ..... 2000-169993 U
Sep. 25, 2000 (JP) ..... 2000-290152 U

(51) Int. Cl.[7] ..... G03G 15/08
(52) U.S. Cl. ..... 399/284; 399/274
(58) Field of Search ..... 399/284, 274, 399/272, 281

(56) References Cited

U.S. PATENT DOCUMENTS 4,115,275 A * 9/1978 Morris ..... 210/386
4,707,748 A * 11/1987 Ohtsuka et al. ..... 399/25 X
4,907,032 A * 3/1990 Enoguchi et al. ..... 399/280
5,680,815 A * 10/1997 Laumann et al. ..... 101/148

FOREIGN PATENT DOCUMENTS

| | | |
|---|---|---|
| EP | 0 155 169 | 9/1985 |
| EP | 1 103 863 | 5/2001 |
| JP | 57-171464 | * 10/1982 |
| JP | 60-103373 | 6/1985 |
| JP | 9-258552 | * 10/1997 |
| JP | 10-104945 | 4/1998 |
| JP | 10-177297 | * 6/1998 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A development apparatus includes a development roller, a supplying roller, and a toner layer regulating member. The development roller contacts an image carrying member and develops an electrostatic latent image into a toner image on the image carrying member. The development roller may be made of aluminum and is rotatably mounted in the apparatus. The supplying roller supplies toner to the development roller. The toner layer regulating member regulates the toner to form a thin film on the development roller. The toner layer regulating member has a roller shape, a surface roughness $R_z$ in a range of from 0.5 $\mu$m to 2 $\mu$m, and a dynamic friction coefficient in a range of from 0.1 to 0.8.

63 Claims, 15 Drawing Sheets

TABLE 1

| SURFACE MATERIAL USED | FRICTION COEFFICIENT ($\mu$) |
|---|---|
| PTFE | 0.05 |
| PFA | 0.07 |
| FLUORIDE-ISOCYANATE (ADJUSTABLE WITH AN AMOUNT OF FLUORIDE RESIN) | 0.08–0.15 |
| LUMIFLON (A COMMERCIAL NAME OF A FLUORIDE RESIN PRODUCT PRODUCED BY ASAHI GLASS CO., LTD.) | 0.27 |
| POLYAMIDE (EXTRUDED TUBE MATERIAL) | 0.32 |
| POLYURETHANE PAINTED (ADJUSTABLE WITH A COMPOSITION OF MATERIALS) | 0.49–0.9 |
| SILICON | 1.1 |
| POLYURETHANE RUBBER | 1.15 |

METHOD AND APPARATUS FOR IMAGE DEVELOPING CAPABLE OF EFFECTIVELY FORMING AN EVEN DEVELOPMENT AGENT LAYER

BACKGROUND OF THE INVENTION

1. Field of the Application

The present application relates to a method and apparatus for image developing, and more particularly to a method and apparatus for image developing which is capable of effectively forming an even development agent layer on a development agent carrying member.

2. Description of the Background

Generally, development apparatuses that develop an electrostatic latent image formed on an image carrying member can be classified into two types. One type develops an electrostatic latent image formed on an image carrying member with a development roller which is brought into contact with the image carrying member. This type is called a contact development apparatus and its development method is referred to as a contact development method. The other type develops an electrostatic latent image formed on an image carrying member with a development roller brought into proximity to the image carrying member. This type is called a non-contact development apparatus and its development method is referred to as a non-contact development method. It is extremely important for both types of the development apparatuses to stably maintain the relative conditions of the development roller and the image carrying member so as to reproduce a superior quality image.

The contact development apparatus, for example, includes a development roller, a toner supplying roller, and a development blade, as important elements. The development roller develops an electrostatic latent image formed on the image carrying member. The toner supplying roller supplies toner to the development roller. The development blade regulates the toner carrier on the development roller into a thin layer having a predetermined thickness. The development roller is held in contact with the image carrying member under a predetermined pressure applied by an elastic member such as a coil spring.

The development agent used for the development of an electrostatic latent image on the image carrying member can also be classified into two types. One type is referred to as a two component development agent that includes toner and carriers. The other type is referred to as a single component development agent that includes toner. The development method using the two component development agent can reproduce a superior quality image in a relatively stable manner but has disadvantages relating to the carriers. For example, the carriers are prone to be degraded over time and a mixture ratio of the toner and the carriers is varied. In addition, the development apparatus using the two component development agent tends to be a relatively large-sized machine. In order to avoid these disadvantages of the two component development agent, it is more convenient to employ the development method that uses the single component development agent.

In the development method using the single component development agent, however, the development roller needs to be held in contact evenly with the image carrying member in a stable manner. Otherwise, the amount of toner supplied to the image carrying member is unstable, which may cause problematic phenomena such as an uneven density on a formed image or a dirty background.

To reproduce a superior quality image, it is required that the development agent carried on the development roller is made into a thin layer by regulating the contact of the image carrying member and the development roller in an area where the development process is conducted.

A Published Japanese Unexamined Patent Application, No. 60-103372 (1985), attempts to regulate the toner into a thin layer in an even manner with a development apparatus using a roll-shaped toner layer regulating member that includes a roll-shaped rubber surface having hardness in a range of 10 degrees to 40 degrees according to the JIS-A (Japanese Industrial Standard-A). However, it is apparent that this structure is not sufficient to succeed in the attempt. In fact, when a polyurethane rubber of hardness in the range of 10 degrees to 40 degrees JIS-A is used for the toner layer regulating member, it is not possible to form an even and thin toner layer because a friction coefficient of such toner layer regulating member is relatively high.

A Published Japanese Unexamined Patent Application, No. 10-104945 (1998), attempts to form an even toner layer and to accelerate toner charging. This attempt uses a roll-shaped toner layer regulating member having a surface roughness $R_z$ in a range of from 2 $\mu$m to 100 $\mu$m, and produces an effect of a vibrating electric field by applying a voltage overlaid with an AC (alternating current) bias to the development roller. This attempt, however, is not practical since it has problematic disadvantages. For example, it requires a coating on the surface of the toner layer regulating member with uniform toner particles and a matrix resin because of the surface roughness $R_z$. Also, this attempt requires a complex configuration which leads to a relatively high manufacturing cost since it uses an AC power source.

FIG. 26 shows a prior art development apparatus that uses a single component development agent. In this prior art development apparatus, a roller-like-shaped development agent carrying member 301 and a roller-like-shaped development agent supplying member 302 are rotated so that development agent contained in a hopper 304 built in a development case 303 is supplied and the development agent is carried on the circumferential surface of the development agent carrying member 301. The development agent carried is formed into a thin layer by a development agent regulating member 305 and is then attracted to an image carrying member (not shown) so that a latent image formed on the image carrying member is developed into a visual image.

The development agent regulating member 305 has, in many cases, a blade-like shape, as shown in FIG. 26, and brings its edge into contact with the development agent carrying member 301 so as to regulate a thickness of the development agent carried. A development agent regulating member including a layer of an elastic substance such as a urethane rubber is applied to a case in which the development agent carrying member includes a hard roller made of a metal or plastic. A metallic development agent regulating member is applied to a case in which the development agent carrying member includes an elastic roller made of rubber.

In a development apparatus using the above blade-shaped development agent regulating member 305, the development agent is subjected to a friction charging process in a nip band region formed between the development agent carrying member and the development agent regulating member. However, the surface of the development agent is prone to be worn over time because of the friction charging process and therefore the charge capacity of the development agent is reduced. As a result, the charge amount on the development agent is reduced which causes problematic phenomena such as a dirty background, failed development of fine dots, etc.

Also, the development agent is prone to melt in the nip band region due to heating caused through the friction charging process. When the melted development agent fixes on the development agent regulating member, it causes a line mark on the development agent carrying member. This causes a problematic white line mark on a recording sheet, as a result.

In addition, foreign substances such as dust particles are prone to be lodged between the development agent carrying member and the development agent regulating member and such lodged foreign substances may cause the above-described white line marks on a recording sheet. A cause of this is in a structure in which the blade-shaped development agent regulating member 305 is fixed with its base edge to the development case 303 such that the top edge thereof contacts the circumferential surface of the development agent carrying member 301 under pressure.

The above-described problems, in many cases, occur in a relatively short time period and they are not easily recovered from when they occur. Accordingly, the life time of the development apparatus is shortened and the development apparatus needs to be frequently exchanged, which increases a user's burden with respect to time and cost. In particular, the blade-shaped development agent regulating member is not a realistic solution for a high speed printing apparatus.

Published Japanese Unexamined Patent Applications, No. JP09-80905 (1997) and No. JP11-84867 (1999), provide exemplary descriptions of prior art development apparatus using roller-shaped development agent regulating members. As shown in FIG. 27, a development agent regulating member 406 includes a shaft 407 supported by supporters 408. The supporters 408 are pressed by pressing members 409 so that the development agent regulating member 406 contacts a development agent carrying member 401 under pressure while rotating in the direction opposite to the rotation direction of the development agent carrying member 401.

In these development apparatus, the roller-like-shaped development agent regulating member 406 is rotated, and it is therefore possible to reduce the occurrence of an event where a foreign particle such as dust is lodged between the development agent carrying member 401 and the development agent regulating member 406.

However, in an image forming apparatus capable of using a large-sized recording sheet (i.e., an A3 size sheet), the development agent regulating member 406 as well as the development agent carrying member 401 necessarily have sufficiently long lengths. Accordingly, the development agent regulating member 406 is prone to be bent when the shaft 407 is pressed by the pressing members 409. When the development agent carrying member 401 is rotated, it pulls the development agent regulating member 406 which is therefore further bent. As a result, the development agent regulating member 406 generates a gap d at the center in the axial direction relative to the development agent carrying member 401, as shown in FIG. 28.

In this case, the pressure of the development agent regulating member 406 relative to the development agent carrying member 401 becomes uneven and, as a result, the layer of the development agent on the development agent carrying member 401 becomes uneven and thick around the center, as shown in FIG. 29. In addition, the charge amount of the development agent becomes extremely low around the center in the axial direction, as shown in FIG. 30. These abnormal conditions lead problematic phenomenon such as a toner dispersion inside the apparatus, etc.

In order to reduce the gap d shown in FIG. 28, the axial diameter of the shaft 407 may be made thicker. However, the shaft 407, even if it is made of steel, is needed to have a diameter of 15 mm or thicker and becomes extremely heavy. This leads to an inevitable necessity of making the whole apparatus.

SUMMARY OF THE INVENTION

The present application describes a novel development apparatus. In one example, a novel development apparatus includes a development roller, a supplying roller, and a toner layer regulating member. The development roller is configured to contact an image carrying member and to develop an electrostatic latent image into a toner image on the image carrying member. In this case, the development roller is made of aluminum and is rotatably mounted in the apparatus. The supplying roller configured to supply toner to the development roller. The toner layer regulating member is configured to regulate the toner to form a thin film on the development roller. In this example, the toner layer regulating member has a roller shape, a surface roughness $R_z$ in a range of from 0.5 $\mu$m to 2 $\mu$m, and a dynamic friction coefficient in a range of from 0.1 to 0.8.

The toner may have a volume average particle diameter in a range of from 6 $\mu$m to 9 $\mu$m.

The development roller may have a surface coated with an anodized aluminum film, a surface subjected to an electroless nickel plating, a surface subjected to a nitriding processing, or a surface coated with a melamine resin.

Further, the present application describes a novel development agent layer regulator. In one example, a novel development agent layer regulator includes a roller which is configured to contact a member for carrying a development agent and to form a thin film of the development agent on the member. This roller has a diameter around a center portion thereof greater than a diameter around end portions thereof and a symmetrical shape about a center line perpendicular to an axis thereof.

Further, the present application describes a novel development apparatus. In one example, a novel development apparatus includes a roller which is configured to contact a member for carrying a development agent and to form a thin film of the development agent on the member. This roller has a diameter around a center portion thereof greater than a diameter around end portions thereof and a symmetrical shape about a center line perpendicular to an axis thereof.

In the above-described development apparatus, a diameter of the roller may be linearly reduced from the center line towards the both end portions, or the diameter of the roller may be of constant within a predetermined width in the center portion and is linearly reduced from edges of the center portion towards both end portions.

In the above-described development apparatus, a length of the roller in an axial direction may be divided into a plurality of sections, a diameter of the roller in each section may be linearly reduced towards the end portion, and angles of slanting line segments formed by the diameters in the plurality of sections relative to the axis of the roller may be stepwise reduced towards the end portions.

The diameters on division lines at which the length of the roller is divided may be set on a single quadric curve or on a single circular arc.

In the above-described development apparatus, an intersection point of adjacent two slanting line segments among the slanting line segments formed by the diameters in the plurality of sections may meet a single circular arc of a predetermined radius.

The slanting line segments formed by the diameters in the plurality of sections may be tangential to a single quadric curve or to a single circular arc.

In the above-described development apparatus, more than one of the diameters on division lines at which the length of the roller is divided may be set on a single quadric curve and more than one of the slanting line segments formed by the diameters in the plurality of sections may be tangential to the same single quadric curve.

In the above-described development apparatus, more than one of the diameters on division lines at which the length of the roller is divided may be set on a single circular arc and more than one of the slanting line segments formed by the diameters in the plurality of sections may be tangent to the same single circular arc.

The diameter of the roller may be varied in the axial direction in accordance with a specific curve of a variant to a fourth power, in accordance with a quadric curve, or in accordance with a circular arc.

In the above-described development apparatus, tangential lines of the specific curve may be used as line segments for both sides of the specific curve so that the diameter of the roller is made relatively greater in both end portions.

In the above-described development apparatus, both end portions of a different curve that touches the specific curve may be used as line segments for both sides of the specific curve so that the diameter of the roller is made relatively greater in both end portions.

The roller may include an elastic layer.

The development agent may include a single component.

Further, the present application describes a novel process cartridge. In one example, a novel process cartridge include a development apparatus which includes a roller. The roller is configured to have a diameter around a center portion thereof greater than a diameter around end portions thereof and to have a symmetrical shape about a center line perpendicular to an axis thereof. The roller contacts a member for carrying a development agent and forms a thin film of the development agent on the member. The process cartridge is detachably installable into an image forming apparatus.

Further, the present application describes a novel image forming apparatus. In one example, a novel image forming apparatus a development apparatus which includes a roller. The roller is configured to have a diameter around a center portion thereof greater than a diameter around end portions thereof and to have a symmetrical shape about a center line perpendicular to an axis thereof. The roller contacts a member for carrying a development agent and forms a thin film of the development agent on the member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
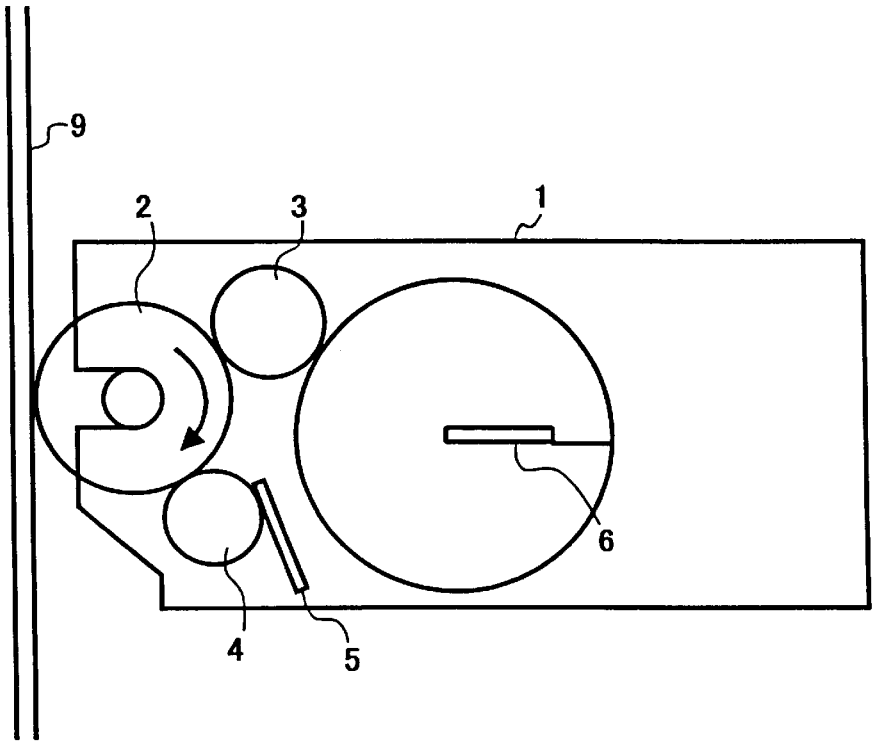
FIG. 1 is an illustration for explaining a development apparatus according to a preferred embodiment of the present application.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, a development apparatus 1 according to a preferred embodiment is explained. The development apparatus 1 shown in FIG. 1 includes a development roller 2, a toner supplying roller 3, a toner layer regulating member 4, a scraping member 5, and a toner transfer member 6. The development roller 2 develops a toner image on a surface of an image carrying member 9 (hereinafter referred to as a photoconductor 9) with a development agent composed of a single component. The toner layer regulating member 4 that has a cylindrical shape such as a roller regulates an amount of toner deposition onto the development roller 2 and makes the toner charged. The scraping member 5 scrapes the toner off the surface of the development roller 2. The toner supplying roller 3 provides the toner with a preliminary charge and supplies the preliminarily charged toner to the development roller 2. The toner transfer member 6 transfers the toner from a hopper (not shown) for containing the toner to the toner supplying roller 3. In this example, the photoconductor 9 has a belt shape, however, it may have a cylindrical shape such as a drum.

The development roller 2 is rotated at a linear velocity ratio 1.1 to 2.0 times as fast as the photoconductor 9 in the direction the same as the photoconductor 9 moves, or in the clockwise direction in FIG. 1. The transfer member 6 is rotated clockwise or counterclockwise to transfer the toner to the toner supplying roller 3. The toner supplying roller 3 includes a metal core (not shown) and a foam member made of polyurethane, silicon, EPDM (ethylenepropylenediene rubber), polycarbonate, etc. The toner supplying roller 3 is configured to contact the development roller 2 under pressure so as to form therebetween a nip band having a predetermined width and is rotated clockwise or counterclockwise at a linear velocity relatively different from that of the development roller 2 so that the toner on the toner supplying roller 3 is preliminarily charged and is transferred to the development roller 2 by the action of friction in the area of the nip band.

The roller-shaped toner layer regulating member 4 is configured to contact the development roller 2 under a predetermined pressure to form a nip band having a predetermined width and regulates the amount of toner that passes through the nip band on the development roller 2. Thus, the toner on the development roller 2 is caused to evenly form a layer thereon. Because the toner thus passing through the nip band receives a charge from the surfaces of the development roller 2 and the toner layer regulating member 4, a charge level of the toner used for the development on the photoconductor 9 is sufficient and stable.

Figure 2:
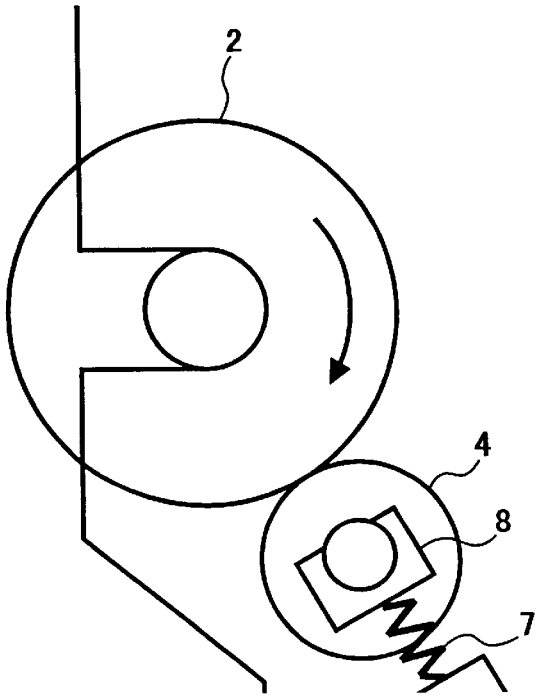
FIG. 2 is an illustration for explaining a method of measuring a pressure applied from a toner layer regulating member to a development roller included in the development apparatus of FIG. 1.

Referring to FIG. 2, an exemplary way of measuring a dynamic friction coefficient of the surface of the toner layer regulating member 4 is explained. The toner layer regulating member 4 is made of aluminum and has a surface roughness $R_z$ in a range of from 0.5 $\mu$m to 2.0 $\mu$m. A pressure spring 7 provides a pressure to an axis supporter 8 so that the toner layer regulating member 4 is applied with a load similar to that applied during an actual operation. The load applied to the toner layer regulating member 4 actually ranges between 3 g/mm and 15 g/mm although it depends on a hardness and a diameter of the toner layer regulating member 4.

During the measurement, the toner is not used and the toner supplying roller 3 and other members contacting the development roller 2 are removed from the development apparatus 1. The toner layer regulating member 4 is tentatively held so as not to be rotated. Then, only the development roller 2 is rotated and its rotation torque is measured with a torque meter. During this process, the development roller 2 is rotated in the same direction as in an actual operation. It is known that the rotation velocity of the development roller 2 does not largely affect the measurement of the torque. Therefore, an appropriate rotation velocity closer to the actual velocity is preferably selected so that variations of the measurements are avoided although it is not necessarily so precise. The relationships among the rotation torque T, the dynamic friction coefficient $\mu$ of the surface of the toner layer regulating member 4, a pressure P between the toner layer regulating member 4 and the development roller 2, and a radius r of the development roller 2 are expressed by the following equation;

$$T=\mu*P*r.$$

Accordingly, the dynamic friction coefficient $\mu$ is expressed by the following equation;

$$\mu=T/(P*r).$$

Figures 3, 4:
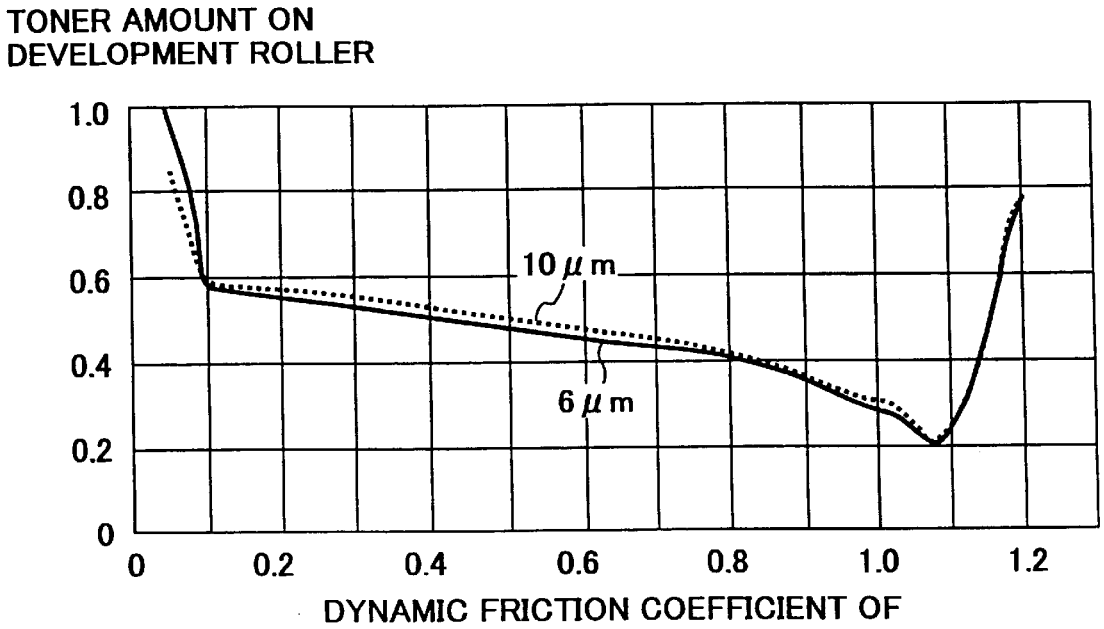
FIG. 3 is a table 1 showing relationships between the types of the toner layer regulating member and a dynamic friction coefficient of the toner layer regulating member relative to the development roller.
FIG. 4 is a graph illustrating a relationship between the dynamic friction coefficient of the toner layer regulating member relative to the development roller and an amount of toner deposited on the development roller.

Exemplary results of the measurements of the dynamic friction coefficient are shown in Table 1 of FIG. 3. In Table 1, each measured value of the dynamic friction coefficient is a result of the measurement on the toner layer regulating member 4 that was covered with a different surface material each time, as indicated in Table 1. The surface of the aluminum roller used during the measurements was conveniently finished with a sandblast of a mesh between #240–#800 and, if it resulted in the surface roughness $R_z$ ranging between 0.5 $\mu$m to 2.0 $\mu$m, the values of the dynamic friction coefficient were not varied.

Referring to FIG. 4, a relationship between the dynamic friction coefficient of the toner layer regulating member 4 and a toner amount m/a (mg/cm$^2$) on the development roller 2 made of aluminum or SUS (stainless steel) is explained. When the aluminum development roller 2 or the SUS development roller 2 was used, the surface roughness $R_z$ of the development roller 2 was preferably in the range between 2 $\mu$m and 3.5 $\mu$m after consideration of the efficiency of the toner transfer and evenness of the toner layer. If the surface roughness $R_z$ of the development roller 2 was relatively small, the toner amount on the development roller 2 was reduced and, on contrary, if it was relatively large, the toner evenness was broken. As a result, an image of uneven density was generated in both cases. Therefore, a development roller 2 having a surface roughness $R_z$ of 2 $\mu$m was used for the measurement of the toner amount m/a on the development roller 2.

Likewise, the surface roughness $R_z$ of the toner layer regulating member 4 is required to be smaller than 4 $\mu$m relative to a general image since it affects the evenness of the toner layer. However, the surface roughness $R_z$ of the toner layer regulating member 4 is preferably smaller than 2 $\mu$m relative to a high precision image such as an image of 600 dpi or more, for example. In the measurement, a toner layer regulating member 4 having a surface roughness $R_z$ of 4 $\mu$m was used.

The hardness of the toner layer regulating member 4 is known to be preferably in a range between 10% and 40% according to the JIS-A (Japanese Industrial Standard-A). However, it was found in the experiment that the toner layer regulating member 4 having a hardness in the range between 5% and 60% JIS-A was successfully used, that is, the toner amount on the development roller 2 was evenly formed by the usage of the development roller 2 having the preferable surface roughness as described above.

FIG. 4 shows the cases of using toner having volume average particle diameters of 6 $\mu$m and 10 $\mu$m. The case of the 10 $\mu$m diameter is first explained. In the measurement, the above-described toner layer regulating member 4 was used.

As shown in the measurement result, when the toner layer regulating member 4 had a dynamic friction coefficient lower than 0.1 and higher than 1.1, the toner amount on the development roller 2 was largely varied. When the toner layer regulating member 4 regulates the toner amount and brings a constant amount of the toner to advance, the regulating force is a friction force generated when the toner particles forwardly moved by the development roller 2 are brought into contact with the surface of the toner layer regulating member 4. Therefore, when the dynamic friction coefficient was made lower than 0.1, this was the case where the toner layer regulating member 4 was not able to hold the toner particles on the surface thereof, which were then easily forwarded by the rotation of the development roller 2 and thus the toner amount was not able to be controlled.

When the toner layer regulating member 4 made of PTFE (polytetrafluroethylene) or PFA (perfluoroalkoxy) was used, the toner overflowed in the above mentioned low dynamic friction coefficient range. In this case, no successful result was obtained even by increasing the pressure. The fluoride-isocyanate increases inclusion of fluoride resin. Therefore, when the toner layer regulating member 4 made of the fluoride-isocyanate was used, the toner layer started to have uneven portions in the dynamic friction coefficient lower than 0.1. However, if the inclusion of the fluoride resin was adjusted to an appropriate level so as to slightly increase the dynamic friction coefficient, the toner layer was evenly formed and the development roller 2 was able to supply an appropriate amount of toner which was 0.6 mg/cm$^2$ or smaller on the development roller 2.

When the dynamic friction coefficient of the toner layer regulating member 4 was changed from lower to higher by changing the materials shown in the table 1 of FIG. 3, the force for regulating the toner was increased and, as a result, the toner amount on the development roller 2 had a tendency to decrease when the dynamic friction coefficient $\mu$ was changed from 0.1 to 0.9.

Toner layer regulating members 4 constructed with materials having relatively large dynamic friction coefficients were also experimentally used. In the case of a silicon rubber having the dynamic friction coefficient $\mu$ of 1.1, it caused an event where the toner amount on the development roller 2 decreased to about 0.2 mg/cm$^2$ and, at the same time, another event where the toner amount on the development roller partly increased because of a vibration created between the toner layer regulating member and the development roller. In the case of a polyurethane rubber having a dynamic friction coefficient $\mu$ of 1.15, it caused a relatively large vibration and, as a result, an increased unevenness of the toner layer on the development roller. It appeared that such a vibration was caused by partly increased friction due to direct contact between the toner layer regulating member and the development roller. That is, the higher dynamic friction coefficient of the toner layer regulating member increased the regulating force relative to the toner on the development roller and accordingly some part of the development roller carried a lesser amount of the toner, which eventually caused the direct contact between the toner layer regulating member and the development roller.

From these experimental results, it was concluded that the dynamic friction coefficient of the toner layer regulating member was required to be within an appropriate range so as to make an even toner layer on the development roller.

When the toner amount m/a on the development roller 2 was smaller than 0.4 mg/cm$^2$, the rotation velocity of the development roller 2 was required to be increased and, as a result, the load on the relevant mechanism was adversely increased. On the contrary, when the toner amount m/a on the development roller 2 was greater than 0.6 mg/cm$^2$, the toner decreased its charge amount and was attracted to the non-image region of the photoconductor 9 which accordingly caused a problematic phenomenon called a dirty background. Therefore, the toner amount on the development roller 2 was adjusted to the range of from approximately 0.4 mg/cm$^2$ to approximately 0.6 mg/cm$^2$. As a result, the dynamic friction coefficient of the toner layer regulating member 4 was set to a value in the range between 0.1 and 0.8 so that a quality image of even density without having dirty background was reproduced.

The case of using the toner having a relatively small volume average particle diameter of 6 $\mu$m, as shown in FIG. 4, is now explained. Using toner of a small diameter, such as in a range 6 $\mu$m to 9 $\mu$m, increased an image resolution and the charge amount of the toner which brought advantages such as increase of a margin to the dirty background and improvement of a gray-scale reproducibility. On the other hand, the toner was prone to be leaked from an area where the toner layer regulating member 4 and the development roller 2 contact each other. This was the reason that the 6-$\mu$m-diameter toner had a sharper rise of the toner amount on the development roller 2 than the 10-$\mu$m-diameter toner in an area where the dynamic friction coefficient of the toner layer regulating member 4 was high. However, from the study based on the above experiments, it was found that when the dynamic friction coefficient of the toner layer regulating member 4 was set to a value of 0.1 or smaller a stable toner layer was successfully formed even with the 6-$\mu$m-diameter toner without causing the toner leakage.

When the toner layer regulating member 4, had a cylindrical shape such as a roller and functioned by being rotated either continuously or intermittently, the toner deposited on the toner layer regulating member 4 adversely affected the charging of the toner and the forming of the toner layer. This happened particularly at a time when the roller-shaped toner layer regulating member 4 made a turn to bring the toner into the nip band area formed between the toner layer regulating member 4 and the development roller 2.

Such toner deposited on the toner layer regulating member 4 needed to be scraped off before it came to the nip band area. In this case, the scraping member 5 which was made in the form of a plate was used to remove the toner deposited on the toner layer regulating member 4. However, the scraping member 5 had difficulty in removing the deposited toner as the size of the toner was made smaller. When the deposited toner was not effectively removed, the toner accumulated around the toner layer regulating member 4. This caused problematic phenomena. For example, the charge of the toner deposited on the toner layer regulating member 4 became unstable. For another example, the toner resin and an additive agent were firmly deposited on the toner layer regulating member 4 so as not to be easily removed afterwards.

The toner layer regulating member 4 having the dynamic friction coefficient of a lower value was advantageous from the viewpoint of the removal of the toner from the toner layer regulating member 4. From the study of the above experiments, it was found that the toner was successfully removed by the scraping member 5 when the dynamic friction coefficient was 0.8 or smaller in the case of using the 6-$\mu$m-diameter toner. Therefore, it appeared that the toner layer was successfully formed in a stable and even manner even with the small-sized toner having the diameter in the range of from 6 $\mu$m to 9 $\mu$m when the dynamic friction coefficient of the toner layer regulating member 4 was set to a value in a range of 0.1 to 0.8. Thereby, the resolution and the gray-scale can be improved and, as a result, a high quality image can be reproduced.

When the development roller 2 made of aluminum or SUS was used for a relatively long period of time, the surface roughness thereof was reduced and the force for transferring the toner was reduced. Accordingly, the toner amount on the development roller 2 was reduced and the life time of the development roller 2 was shortened.

The life times of the development rollers 2 made of aluminum and SUS in the number of print sheets were about 10,000 sheets and 20,000 sheets, respectively. Since it was not practical to exchange only the development roller 2 in the development apparatus 1, the whole development apparatus 1 was exchanged when the life time of the development roller 2 expired. That is, the life time of the development roller 2 determined the life time of the development apparatus 1. The development apparatus 1 had the life time of 100,000 sheets or more, however, this life time was shortened to one-fifth due to the life time of the development roller 2. To avoid this waste, the development roller 2 needed to be improved in an antifriction characteristic. But, when the development roller 2 was improved in the antifriction characteristic (i.e., an abrasion resistance was increased), the toner resin and the additive agent were prone to be firmly deposited on the development roller 2. As a result, various problematic phenomena were caused such as reduction of the resolution, occurrence of the dirty background, reduction of a halftone evenness, etc. and an inferior quality image was accordingly reproduced. Therefore, the conditions in which the firm toner deposition on the development roller 2 occurred were investigated. As a result of the investigation, it was found that the firm toner deposition on the development roller 2 occurred when the dynamic friction coefficient of the toner layer regulating member 4 was 0.8 or greater which then increased an amount of frictional heating. The increased frictional heating increased the surface temperature of the development roller 2 and, as a result, the increased surface temperature of the development roller 2 was prone to cause the above-mentioned firm toner deposition. Therefore, the life time of the development apparatus 1 can be extended by using the high-abrasion-resistant development roller 2 together with the toner layer regulating member 4 having the dynamic friction coefficient in the range of 0.1 to 0.8.

In the above experiment, another type of the development roller 2 was used, which was coated with an anodized aluminum film so as to increase the surface hardness from 70 Hv of the aluminum to 350 Hv according to the Vickers hardness test. When this development roller 2 was used together with the toner layer regulating member 4 having the dynamic friction coefficient of 0.1 to 0.8, the development apparatus 1 reproduced a superior quality image for 70,000 sheets.

In the above experiment, another type of the development roller 2 was used, which was subjected to an electroless nickel plating so as to increase the surface hardness from 70 Hv of the aluminum to 400 Hv according to the Vickers hardness test. When this development roller 2 was used together with the toner layer regulating member 4 having the dynamic friction coefficient of 0.1 to 0.8, the development apparatus 1 successfully reproduced a superior quality image for 80,000 sheets.

In the above experiment, another type of the development roller 2 was used, which was subjected to a nitriding processing so as to increase the surface hardness from 250 Hv to 600 Hv according to the Vickers hardness test. When this development roller 2 was used together with the toner layer regulating member 4 having the dynamic friction coefficient of 0.1 to 0.8, the development apparatus 1 successfully reproduced a superior quality image for 100,000 sheets.

The above examples of the long life development apparatus used the development roller 2 which had the metal surface or the oxidation layer and in which the surface roughness of such surface or layer was used to exploit the characteristic of the toner transportation. In these cases, the dynamic friction coefficient of the toner layer regulating member 4 was defined by the case of aluminum and which could be applied to other cases as well.

As described above in the discussion about the cases of using the small-sized diameter toner, a quality improvement of image was achieved by increasing a charge on the toner. To increase the charge on the toner, contact charging was preferably conducted between the development roller 2 and the toner. In addition, conditions in which the development roller 2 had the long life and the function for applying a charge to the toner were studied and, as a result, it was found that the development roller 2 coated with a melamine resin film showed a successful result.

In the above experiment, when one type of the development roller 2 coated with the melamine resin film was used together with the toner layer regulating member 4 having the dynamic friction coefficient of 0.1 to 0.8, the development apparatus 1 successfully reproduced a superior quality image for 140,000 sheets. When the development roller 2 coated with the melamine resin film having the surface roughness of smaller than 1 $\mu$m was used, the toner was still successfully transferred without causing the reduction of the toner amount m/a on the development roller 2 which was normally caused by the reduction of the surface roughness of the development roller 2. Therefore, the life time of the development roller 2 was extremely longer than the development apparatus 1. In addition, the charge amount of the toner was increased with this development roller 2 and therefore a superior quality image was successfully reproduced.

In this development roller 2, the toner transportation mechanism relies on tackiness of the surface of the development roller 2 relative to the toner rather than the surface roughness of the development roller 2. Therefore, the life time of the development roller 2 will be extended for an extremely long time period unless the firmly deposited toner occurs relative to the development roller 2.

It is noted, however, that an appropriate value of the dynamic friction coefficient of the toner layer regulating member 4 relative to the toner amount m/a on the development roller 2 was experimentally proved to be within the range of 0.1 to 0.8 and, further, when the value was out of the range of 0.1 to 0.8, the above-mentioned problematic phenomena occurred.

Figure 5:
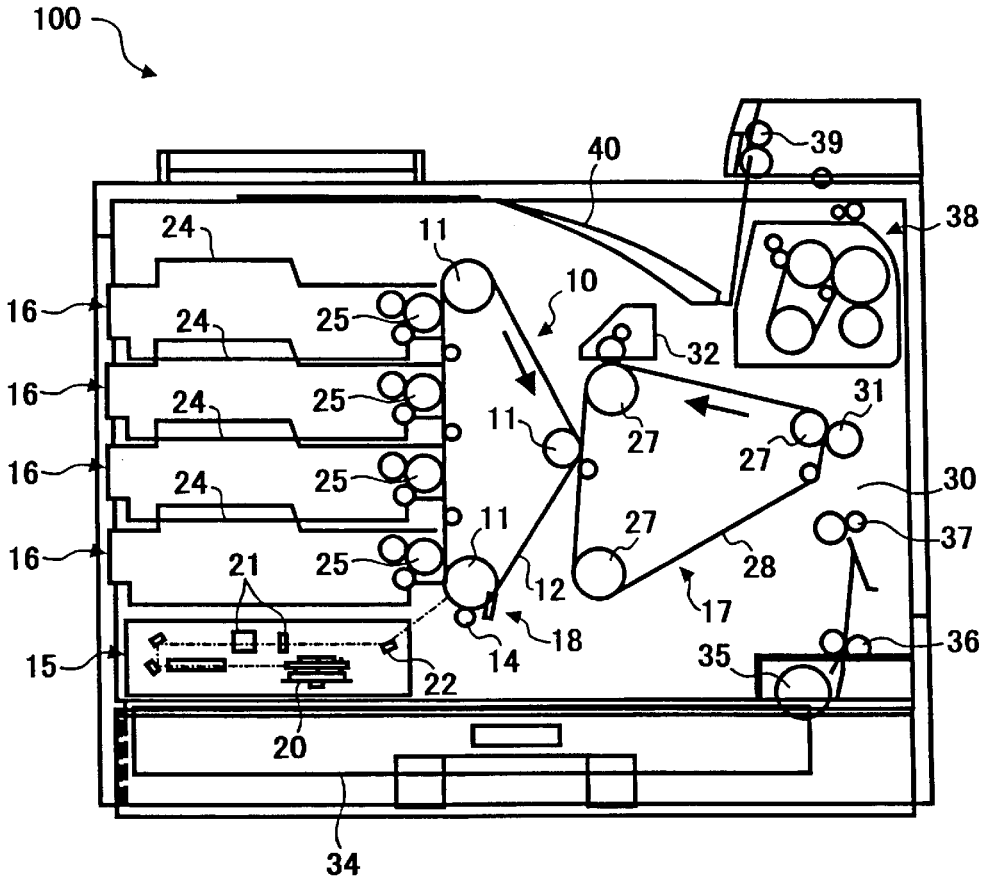
FIG. 5 is a schematic diagram of a cross-sectional view of a color laser printer according to the present application.

FIG. 5 shows a color laser printer 100 according to a preferred embodiment of the present application. The color laser printer 100 of FIG. 5 includes a photoconductor unit 10 approximately at a center thereof. The photoconductor unit 10 includes a plurality of rollers 11 and an image carrying member 12, an endless belt. The image carrying member 12 is extended under tension on the plurality of rollers 11. The image carrying member 12 is coated with an organic photoconductive layer.

The color laser printer 100 further includes a charging unit 14, a laser writing unit 15, four development units 16, an intermediate transfer unit 17, and a cleaning unit 18, which are provided around the photoconductor unit 10.

The charging unit 14 evenly charges the surface of the image carrying member 12 by applying a relatively high voltage thereto.

The laser writing unit 15 includes a laser diode (not shown) and controls it to emit laser light in accordance with a color image signal provided from a computer, for example, towards the surface of the image carrying member 12 via a polygon mirror 20, an f/? (ef/theta) lens 21, and a reflection lens 22. Thereby, the image writing process is performed according to signals of black, cyan, magenta, and yellow colors and an electrostatic latent image is formed on the image carrying member 12.

Each development unit 16 contains a non-magnetized single component development agent of a black, cyan, magenta, or yellow color and is detachably mounted. The four development units 16 are vertically stacked and are selectively activated so as to come close to the image carrying member 12. Each development unit 16 includes a roller-like-shaped development agent carrying member 25 installed inside a development case 24 of the development unit 16. When the development unit 16 is activated, the development agent carrying member 25 is brought into contact or a close proximity to the image carrying member 12.

The intermediate transfer unit 17 includes an intermediate transfer endless-belt 28 that is extended under pressure on a plurality of rollers 27. The intermediate transfer endless-belt 28 is coated with an organic photoconductive layer. The intermediate transfer unit 17 further includes a sheet passage 30, an intermediate roller 31, and an intermediate belt cleaning unit 32 which are deposited around the intermediate transfer belt 28. The intermediate belt cleaning unit 32 contacts the intermediate belt 28 under pressure.

The cleaning unit 18 includes a cleaning blade (not shown) that contacts the image carrying member 12 under pressure.

The color laser printer 100 includes a detachable sheet cassette 34 at the bottom thereof. The sheet cassette 34 sends a recording sheet by rotation of a sheet feed roller 35 into the sheet passage 30 and further transfers it with transfer rollers 36 towards a contact region between the intermediate transfer belt 28 and the intermediate transfer roller 31 in synchronism with a registration roller 37.

The color laser printer 100 further includes a fixing unit 38 and ejection rollers 39 along the downstream parts of the sheet passage 30. A sheet stacker 40 for stacking recorded sheets face down is formed at the upper part of a housing of the color laser printer 100.

To perform a recording operation, the rollers 11 and the rollers 27 are rotated so that the image carrying member 12 and the intermediate transfer belt 28 are rotated in the directions indicated by the respective arrows in FIG. 5. At the same time, the sheet feed roller 35 is rotated to feed a recording sheet to the contact region of the intermediate transfer belt 28 and the intermediate transfer roller 31 via the sheet passage 30.

Also, the charging unit 14 is activated to charge the surface of the image carrying member 12 and, then, the writing process is performed with the laser writing unit 15 so that an electrostatic latent image is in turn formed for each color on the image carrying member 12. Subsequently, the electrostatic latent image is developed into a visible image in each color by the development unit 16 with the development agent that is charged to a reverse polarity relative to the electrostatic latent image. The image developed in each color is then sequentially transferred onto the intermediate transfer belt 28 by being applied with a charge of a reverse polarity relative to the polarity of the development agent. Thus, four separate color images are overlaid on the intermediate transfer belt 28 to form a synthesized full color image.

The color image formed on the intermediate transfer belt 28 is transferred onto the recording sheet by being applied with a charge of a reverse polarity relative to the polarity of the development agent with the intermediate transfer roller 31. The recording sheet having the color image thereon is fed into the fixing unit 38 where the color image is fixed and is then ejected with the ejection rollers 39 to the sheet stacker 40.

After the transfer process, the image carrying member 12 prepares for the next image forming process by proceeding into a cleaning process in which the cleaning unit 18 cleans residual development agent off the surface of the image carrying member 12 with its cleaning blade. Also, the intermediate transfer belt 28 prepares for the next transfer process by proceeding into a cleaning process in which the intermediate belt cleaning unit 32 cleans residual development agent off the surface of the intermediate belt cleaning unit 32 with its cleaning blade.

Figure 6:
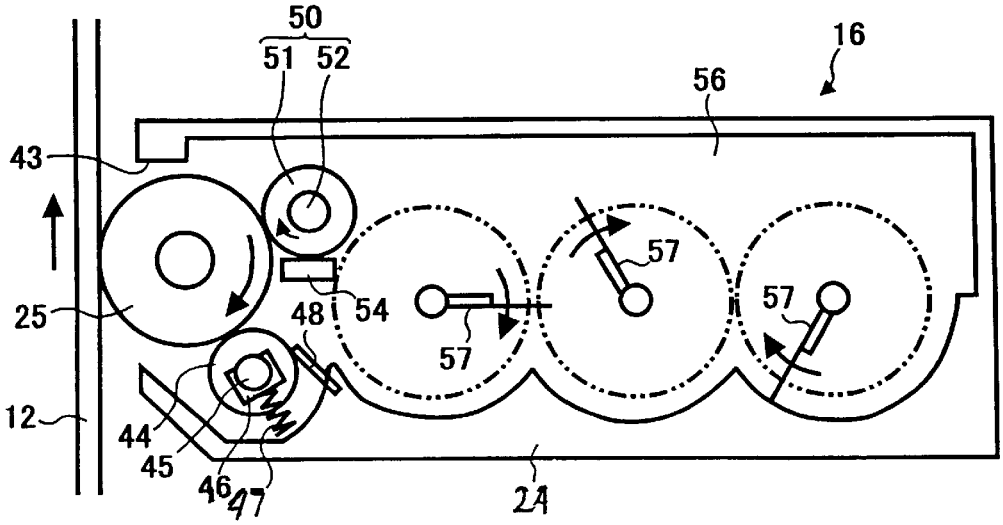
FIG. 6 is a schematic diagram of a cross-sectional view of a development unit included in the color laser printer of FIG. 5.

As shown in FIG. 6, the development unit 16 includes a development case 24, having an opening 43, and a development agent carrying member 25 facing the image carrying member 12 through the opening 43. The development agent carrying member 25 is rotated at a linear velocity ratio from 1.0 to 2.0 relative to the image carrying member 12 in the same direction as the image carrying member 12. The development agent carrying member 25 is pressed by a development agent regulating member 44 which is formed in a roller-like shape.

Figure 7:
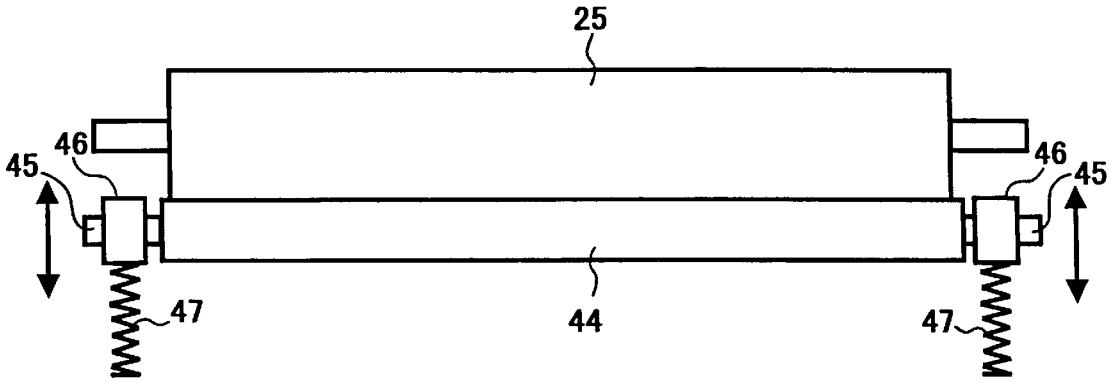
FIG. 7 is an illustration for explaining a supporting mechanism of a development agent regulating member relative to a development agent carrying member.

The development agent regulating member 44 includes a shaft 45 and supporting members 46, as shown in FIG. 7, and is supported by the development case 24 via the shaft 45 and the supporting members 46. The supporting members 46 are pressed by pressing members 47 (i.e., springs) so that the development agent regulating member 44 is pressed against the development agent carrying member 25. The development agent regulating member 44 is rotated in the direction opposite to the rotation of the image carrying member 25.

The development agent regulating member 44 is pressed by a top edge of a scraping member 48, as shown in FIG. 6, which scrapes the development agent off the surface of the development agent regulating member 44.

The development agent carrying member 25 contacts a development agent supplying member 50 and forms a nip band having a predetermined width. The development agent supplying member 50 that has a roller-like shape includes a metal core 51 and a foam member 52 made of polyurethane, silicon, EPDM, polycarbonate, etc. Such development agent supplying member 50 is rotated in the direction opposite to and at a different linear velocity at the nip band area relative to the development agent carrying member 25, although the development agent supplying member 50 may be rotated in the opposite direction. Under the development agent supplying member 50, a separation plate 54 is provided.

Inside the development case 24, a hopper 56 containing non-magnetized single component development agent for black, cyan, magenta, and yellow colors is provided. Inside the hopper 56 are a plurality of development agent transporting members 57. The development agent transporting member 57 is rotated clockwise in FIG. 6, although it may be rotated counterclockwise.

In the development unit 16, the development agent carrying member 25 is either a hard type or a soft type. A hard type is, for example, a metal roller made of aluminum, SUS, steel, etc., a metal core as such coated with a plastic resin such as a melamine resin or the like, or a metal core as such coated with a hard rubber including fluoride resin or the like.

A soft type is a metal roller or a metal shaft covered by an elastic rubber layer and a surface layer. For example, it may be a steel shaft provided with a layer made of silicon, NBR (acrylonitrilebutadiene rubber), hydrin, urethane, or the like and further with a surface layer made of fluoride resin, guanamine resin, or the like.

In the case when the development agent carrying member 25 is a hard type, the development agent regulating member 44 is required to be one which includes an aluminum or SUS or steel metal roller coated with a plastic resin such as a melamine resin or with a relatively hard rubber such as a fluoride resin.

In the other case when the development agent carrying member 25 is a soft type, the development agent regulating member 44 is required to be one which includes a metal roller or a metal shaft covered by an elastic rubber layer which is further covered by a surface layer. One example is a steel shaft covered by a layer of silicon, NBR, hydrin or the like which is further covered by a surface layer of fluoride resin, guanamine resin, or the like. A SUS shaft may be used, and its durability may be extended if the surface is hardened by a nitrifying process.

The materials used for both the development agent carrying member 25 and the development agent regulating member 44 need to satisfy various factors such as a charging characteristic relative to the charge of the toner, stable conditions over long periods of time, abrasion resistance, and protection of development agent deposition.

When the development unit 16 develops the latent image formed on the image carrying member 12, the development agent is agitated and transported by the rotation of the development agent transporting member 57 onto the separation plate 54 and is then attached to the development agent supplying member 50. The development agent supplying member 50 is rotated to bring the development agent into contact with the development agent carrying member 25 under pressure so that the development agent is primarily charged and is attracted to the development agent carrying member 25 with a Coulomb force.

The development agent carrying member 25, which is rotated and carries the development agent, brings the development agent into contact under pressure with the development agent regulating member 44 so that the development agent is regularly charged and is regulated into a thin layer. Then, the development agent attaches to the image carrying member 12 so that the latent image on the image carrying member 12 is developed into a visualized image.

In this example, the image carrying member 12 has a belt shape, as illustrated in FIG. 6. However, a drum-like-shaped member may be used for the image carrying member if a surface hardness is sufficiently low.

Figure 8:
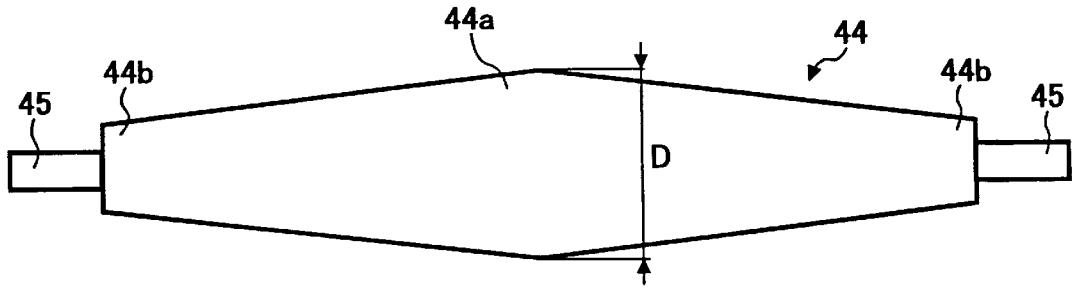
FIG. 8 is an illustration for explaining an example of a shape of the development agent regulating member.

In this application, the development agent regulating member 44 has a varying outside diameter, the center outside diameter being greater than both end outside diameters, and has left and right halves in symmetric shapes. For example, as shown in FIG. 8, the development agent carrying member 44 has a diameter D at a center portion 44*a* which is linearly varied to a small diameter towards end portions 44*b*. An actual difference between the diameter D of the center portion 44*a* and the diameters of the end portions 44*b* is in a range of from 50 $\mu$m to several hundreds of $\mu$m.

Because of this varying diameter of the development agent regulating member 44, the development agent regulating member 44 forms a small gap with and evenly contacts with the development agent carrying member 25 even when the development agent regulating member 44 is bent by a force of the pressing members 47 or the rotation of the development agent carrying member 25.

Figure 9:
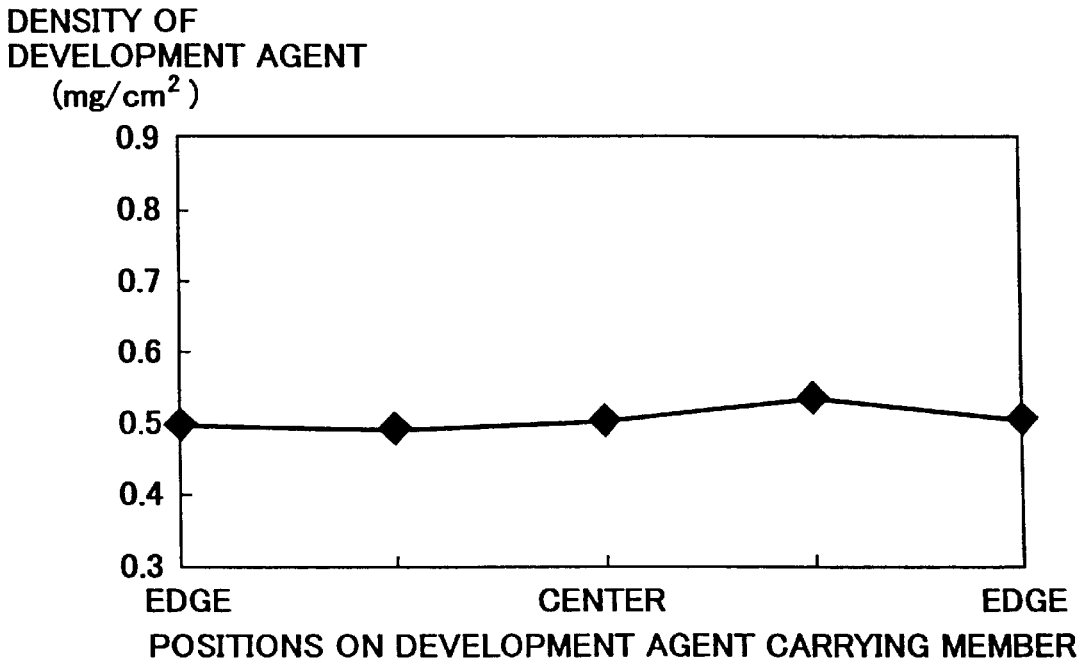
FIGS. 9 and 10 are graphs for demonstrating relationships between the density of the development agent and the charge amount of the development agent respectively and a position on the development agent regulating member in the axial direction.
Figure 10:
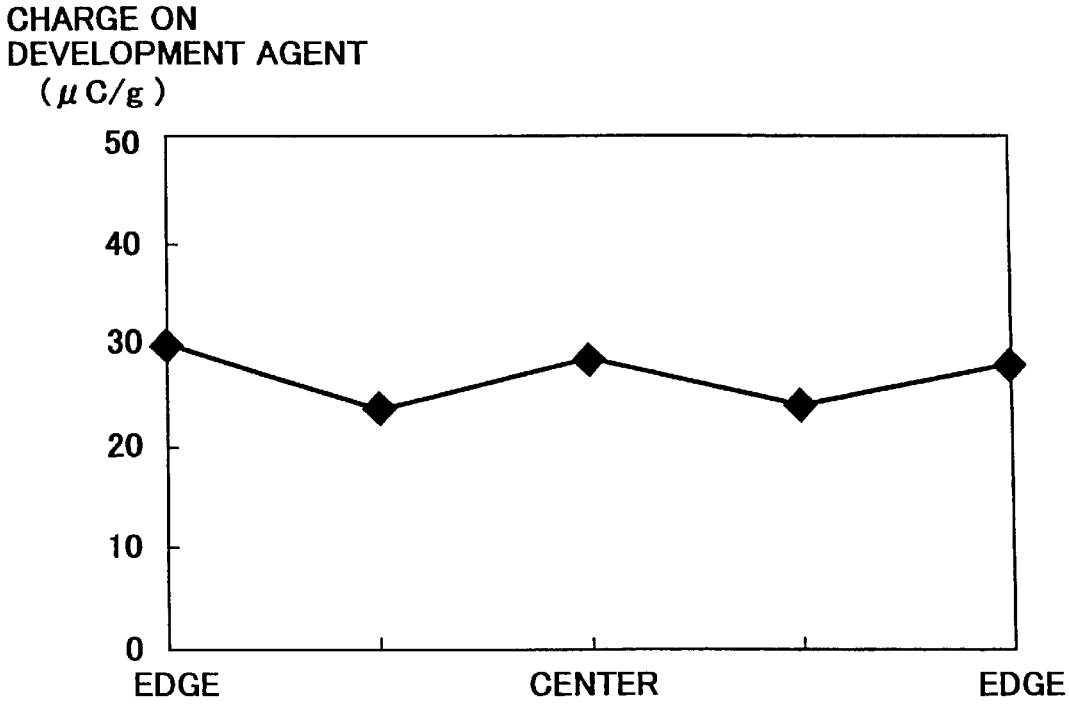

Thereby, it is possible that the development agent is evenly formed into a layer on the development agent carrying member 25, as shown in FIG. 9, wherein an X-axis represents positions on the development agent carrying member 44 along the axis direction thereof and a Y-axis represents a density of the development agent formed in the layer on the development agent carrying member 44. Further, it is possible that the development agent layer on the development agent carrying member 25 has an even amount of charge in the axis direction of the development agent regulating member 44, as shown in FIG. 10, wherein an X-axis represents positions on the development agent carrying member 44 in the axis direction thereof and the Y-axis represents a charge amount of the development agent formed on the layer on the development agent carrying member 44. By thus reducing the variations of the charge amount, a problematic phenomenon such as a dispersion of the development agent inside the apparatus can be eliminated and, as a result, the color laser printer 100 can reproduce a superior quality image. In addition, it is possible to make the development agent regulating member 44 have a shape of FIG. 8 without highly affecting the manufacturing cost.

It is also possible to reduce the weight of the development agent regulating member 44 by reducing the diameter of the shaft 45, thereby reducing the driving torque.

However, on the development agent regulating member 44 having the shape of FIG. 8, the charge is not evenly distributed and is varied in a W-like-shaped form in the axial direction, as shown in FIG. 10. This indicates that the pressure relative to the image carrying member 25 is relatively weak at the center portion 44*a* and the end portions 44*b*.

Figure 11:
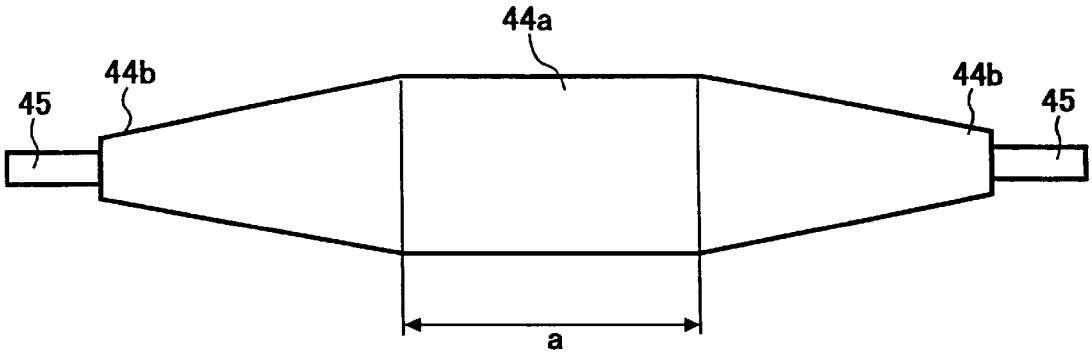
FIGS. 11 and 12 are illustrations for explaining different examples of the shape of the development agent regulating member.

In order to evenly distribute the charge amount, the development agent regulating member 44 is made to have the shape, as shown in FIG. 11, that is, the diameter D of the development agent regulating member 44 is made constant for a length a in the center portion 44*a* and is linearly decreased by a relatively small amount from both edges of the length a towards the respective end portions 44*b*.

With the above arrangement, the diameters of the center portion 44*a* and the end portions 44*b* can be made greater and therefore the development agent regulating member 44 is evenly pressed against the development agent carrying member 25. As a result, a phenomenon in that the charge amount is partially reduced is reduced and the development agent layer has a more even charge amount.

However, even when the development agent regulating member 44 is made to have the form shown in FIG. 11, the above-mentioned phenomenon is not perfectly eliminated and the development agent layer slightly has an uneven charge amount. This is because the pressure applied to the development agent regulating member 44 is still prone to be uneven, in particular, at positions where the slopes are started from the both edges of the length a towards the respective end portions 44*b*.

Then, the length of the development agent regulating member 44 is divided into a plurality of sections and the diameter D of each section is linearly reduced so that, starting from the center portion 44*a*, the slope angle is stepwise increased section by section towards the end portions 44*b*.

Figure 12:
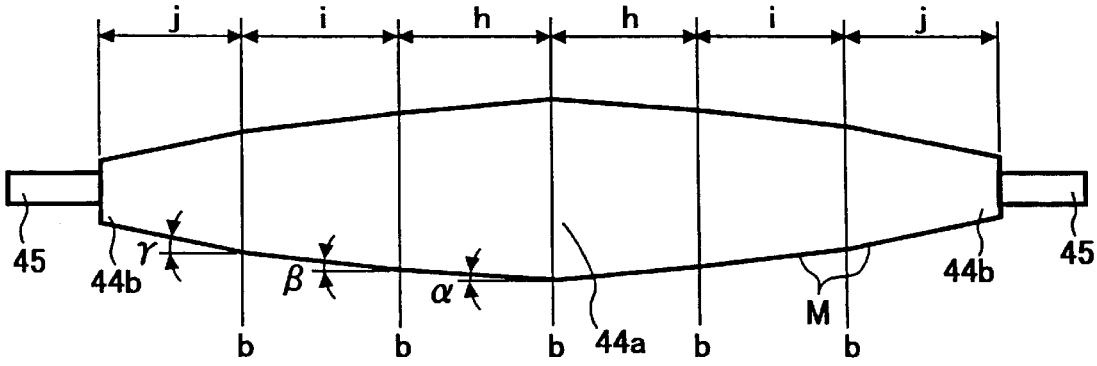

As shown in FIG. 12, for example, the length of the development agent regulating member 44 is symmetrically divided from the center portion 44*a* into two sets of sections h, i, and j at positions b. The outer diameter D of each section is linearly reduced and line segments M indicating such reductions of the outer diameter are successively varied so that slope angles α, β, and γ are stepwise increased section by section towards the end portions 44*b*.

With this arrangement, the development agent regulating member 44 is more evenly pressed against the development agent carrying member 25. As a result, a phenomenon in that the charge amount is partially reduced is further reduced and the development agent layer has a far more even charge amount so that the color laser printer 100 can reproduce a superior quality image.

Based on a model of an equally distributed load, a bending of the development agent regulating member 44 in the roller shape can be expressed by an equation;

$$w=q*L^4/(24EI)*(x/L)*(1-2*(x/L)^2+(x/L)^2),$$

wherein w represents an extent of bending at a position x, q represents a value resulting from a division of the total load by the length of the development agent regulating member 44, L represents the length of the development agent regulating member 44, E represents the Young's modulus of the shaft 45, I represents a secondary moment of a cross-section and is equal to $\pi*d^4/64$, and d represents the diameter of the shaft 45.

From the above equation, w is determined as proportional to $x^4$. Accordingly, the development agent regulating member 44 is arranged to have the diameter D that varies lengthwise by a curve of a variant (i.e., an x) to the fourth power. This makes the development agent regulating member 44 more evenly pressed against the development agent carrying member 25. As a result, a phenomenon in that the charge amount is partially reduced is further reduced and the development agent layer has a far more even charge amount so that the color laser printer 100 can reproduce a superior quality image.

However, in an actual operation, the development agent is prone to flow in the direction from the center portion 44*a* to both end portions 44*b* and, as result, the pressure from the development agent particles around the end portions 44*b* is increased. Therefore, the counter pressure applied around the end portions 44*b* needs to be increased.

Figure 13:
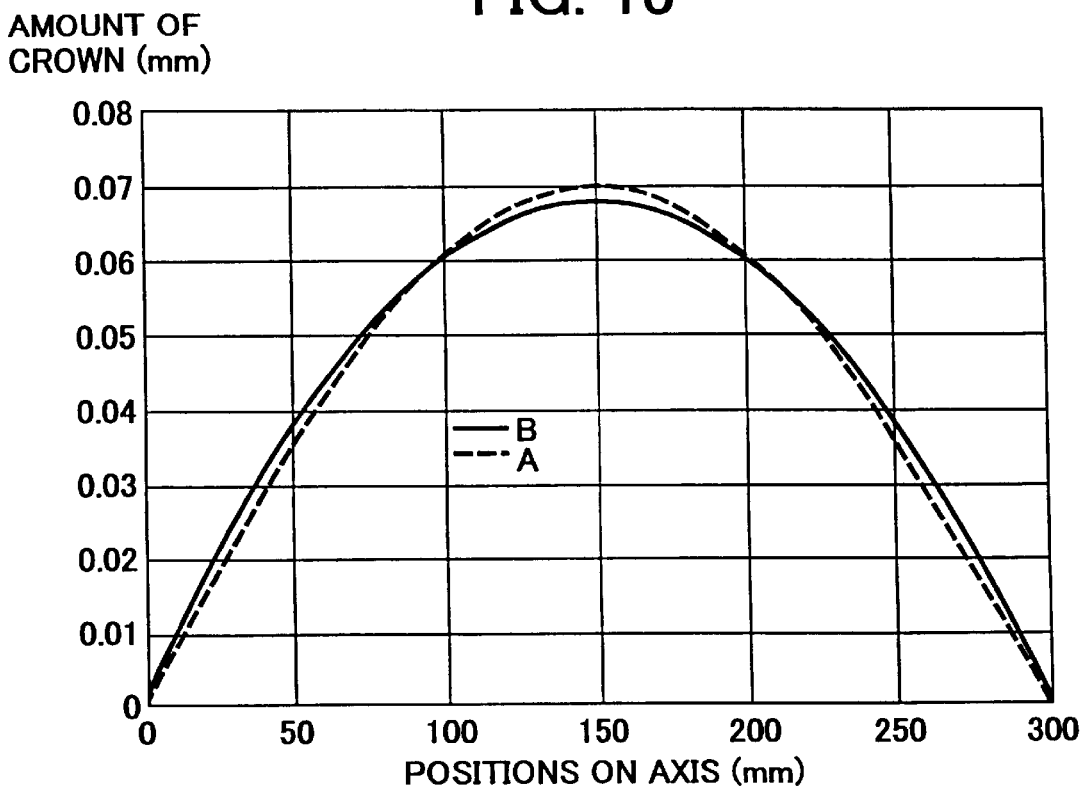
FIGS. 13 and 14 are graphs for demonstrating relationships of an amount of crown and a position in the axial direction of the development agent regulating member having further different shapes.
Figure 14:
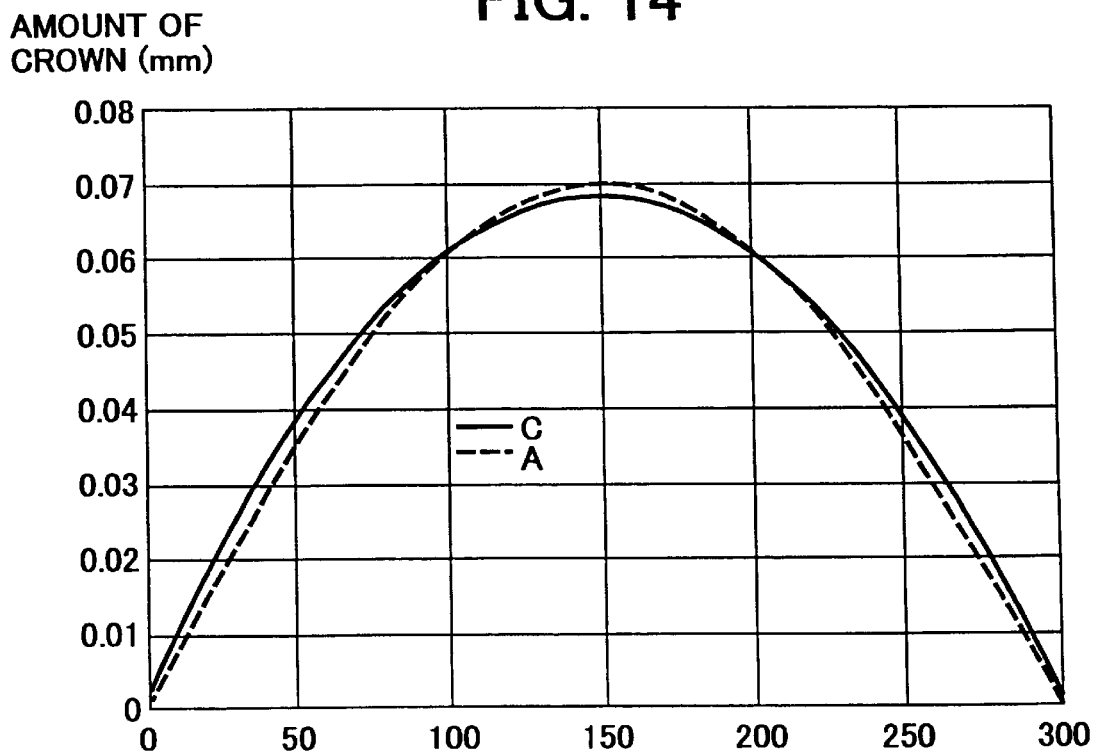

Therefore, it is more preferable to apply a quadric curve or a circular arc to the diameter D rather than applying a curve of a variant (i.e., an x) to the fourth power. FIGS. 13 and 14 compare a curve A of a variant (i.e., an x) to the fourth power with a quadric curve B and a circular arc C, respectively. In FIGS. 13 and 14, the X-axes are commonly represent axial positions of the development agent regulating member 44 and the Y-axes are commonly represent an amount of crown that represents a difference between radiuses of the two curves. That is, for example, when the development agent regulating member 44 has the length of 300 mm and the center diameter of 14 mm, the amount of crown at the center portion 44*a* which is 150 mm away from the end portions 44*b* is set to 0.07 mm and the diameters of the end portions 44*b* are 13.86 mm which is smaller than that of the center diameter by 0.14 mm. When the development agent regulating member 44 bears a greater load particularly at the both end portions 44*b*, the amount of crown at the center portion 44*a* needs to be increased.

Figure 15:
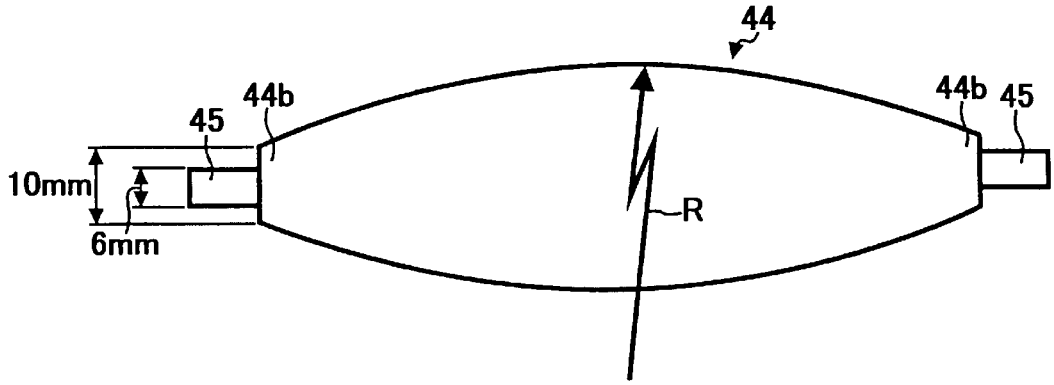
FIG. 15 is an illustration for explaining a further different example of the shape of the development agent regulating member.

FIG. 15 shows one example of the development agent regulating member 44 having a roller shape. In this case, the development agent regulating member 44 is made through a traversal grinding or a plunge grinding so as to have the diameter D varying in accordance with a circular arc in the axial direction. That is, the diameter d of the shaft 45 is 6 mm, the diameter at the end portions 44*b* is 10 mm, and the perimeter of the roller in the axial direction is formed on the basis of a circular arc made by a radius R of 80 to 100 mm.

It may also be preferable to use the roller shape of FIG. 12. That is, the length of the development agent regulating member 44 is symmetrically divided from the center portion 44*a* into the sections at the positions b. The outer diameter D of each section is linearly reduced towards the end portions 44*b* and line segments M indicating such reductions of the outer diameters are successively varied so that the slope angles α, β, and γ are stepwise increased section by section. In this case, the outer diameter D at each position b is located on a single quadric curve.

Figure 16:
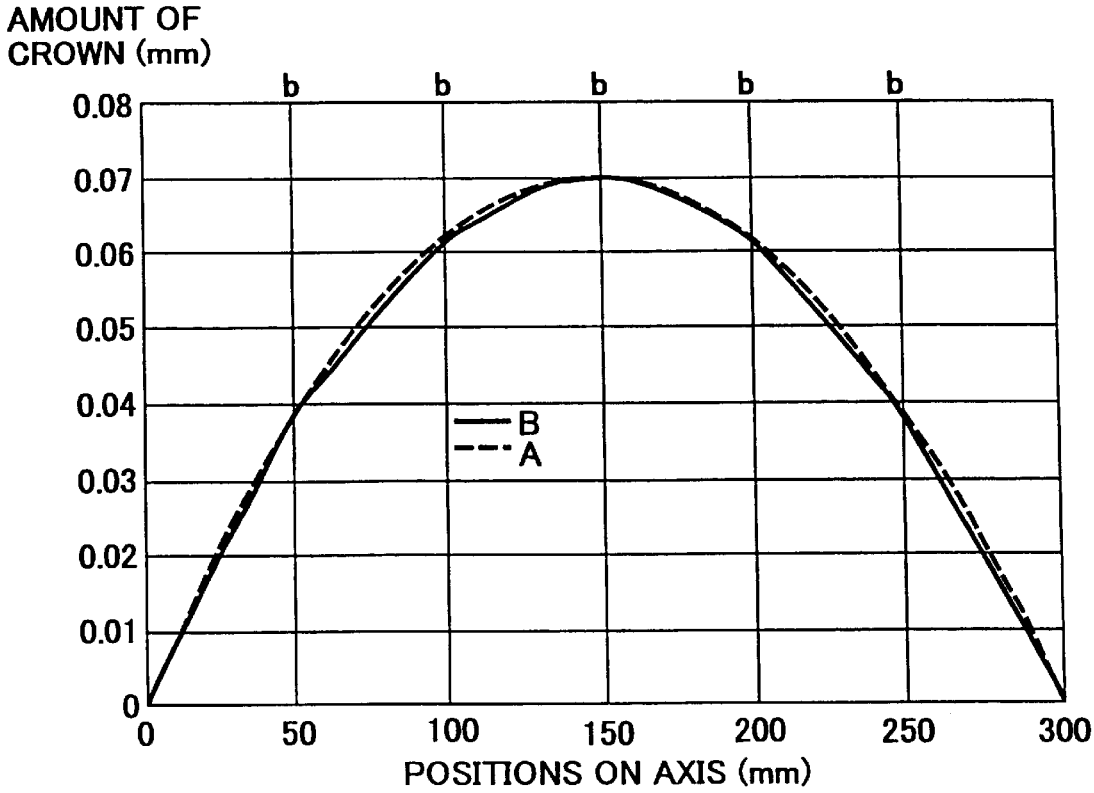
FIGS. 16–18 are graphs for demonstrating relationships of the amount of crown and the position in the axial direction of the development agent regulating member having further different shapes.

For example, it is preferable for the outer diameter D at each division position b to be located on a single quadric curve. FIG. 16 shows a relationship between a single quadric curve A and a line B made of the line segments M at the division positions b in this case. The outer diameter D at each division position b may alternatively be located on a single circular arc, although it is not shown. In this case, the line B includes 8 line segments M.

For another example, although it is also not shown, the outer diameters at the division positions b are adjusted so that a top of the radius R meets each point of intersection of two adjacent line segments M.

Figure 17:
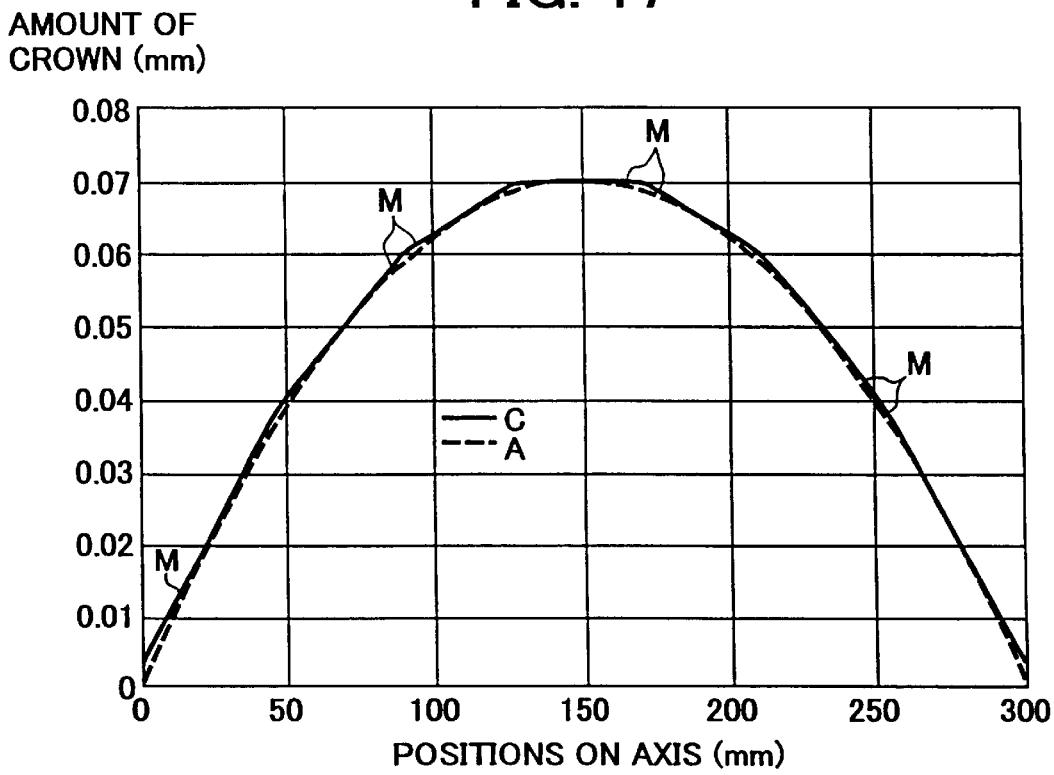

For another example, as shown in FIG. 17, it is also preferable for the line M at each division point b to meet the same quadric curve A. FIG. 17 shows a relationship between the quadric curve A and a line C made of the line segments M at the division positions b in this case. The line M at each division point b may alternatively be located on a single circular arc, although it is not shown. In this case, the line C includes 7 line segments M.

Figure 18:
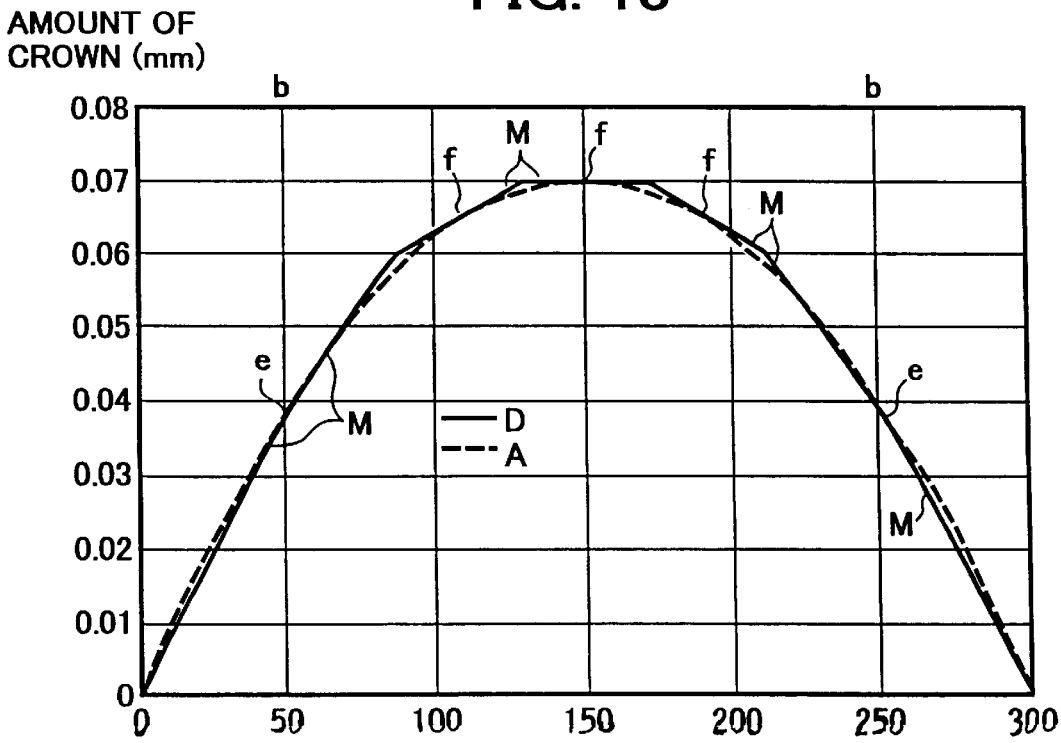

Further, as shown in FIG. 18, it is preferable to make several outer diameters at the division points b to meet a single quadric curve A, as indicated by letters e, and to make several line segments M included in a line D to meet the quadric curve A, as indicated by letters f. In this case, the line D includes 7 line segments M. The quadric curve A may be replaced by a single circular arc.

As described above, in an actual operation, the development agent is prone to flow in the direction from the center portion 44*a* to the both end portions 44*b* and, as a result, the pressure by the development agent particles around the end portions 44*b* is increased. Therefore, the counter pressure applied around the end portions 44*b* needs to be increased. Therefore, it is also preferable to use tangent lines of a curve as both ends of the curve so as to make the outer diameter D greater at the end portions 44*b*.

Figure 19:
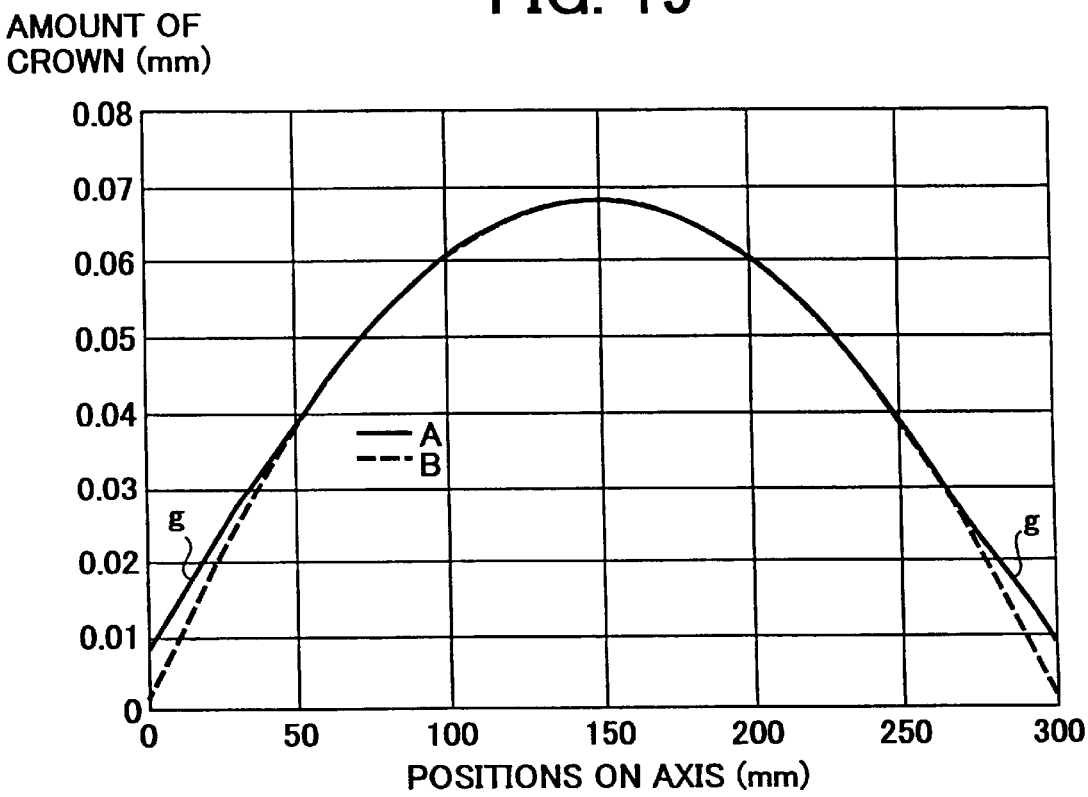
FIGS. 19 and 20 are a graph and an illustration for explaining further different shapes of the development agent regulating member.
Figure 20:
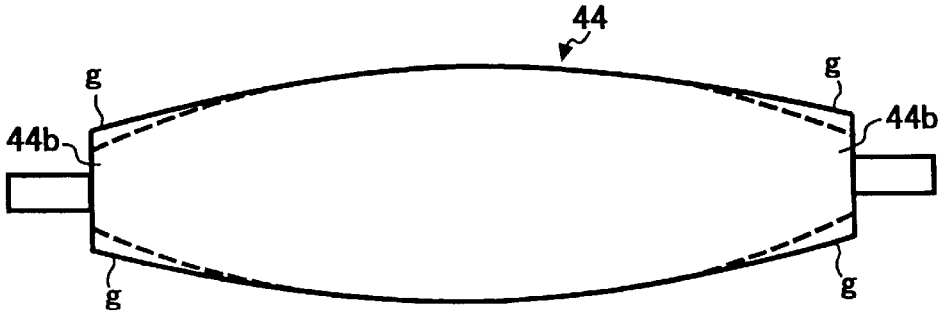

For example, as shown in FIG. 19, tangent lines g of a curve A are used as both ends of the curve A so as to make the outer diameter D extended at the end portions 44*b* along a line B that includes the tangent lines g and the curve A. Accordingly, FIG. 20 shows that the outer diameter D is corrected according to the lines g around the end portions 44*b*.

Figure 21:
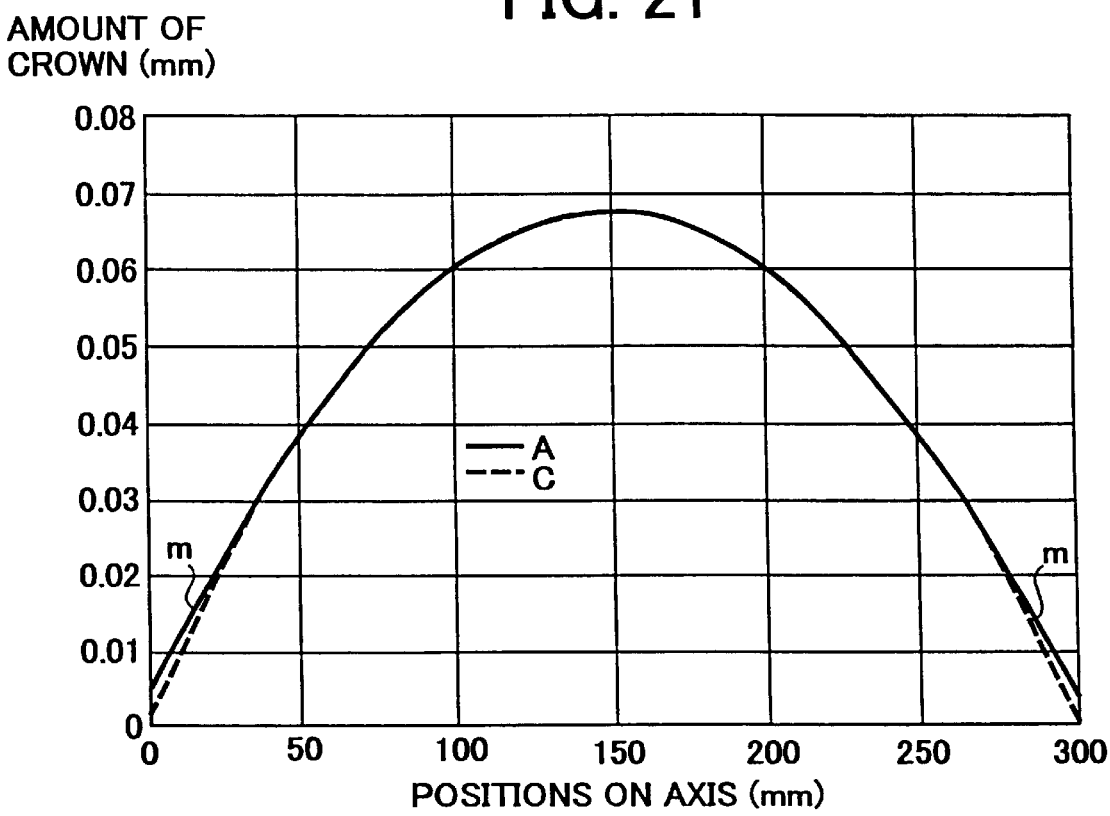
FIGS. 21 and 22 are a graph and an illustration for explaining further different shapes of the development agent regulating member.
Figure 22:
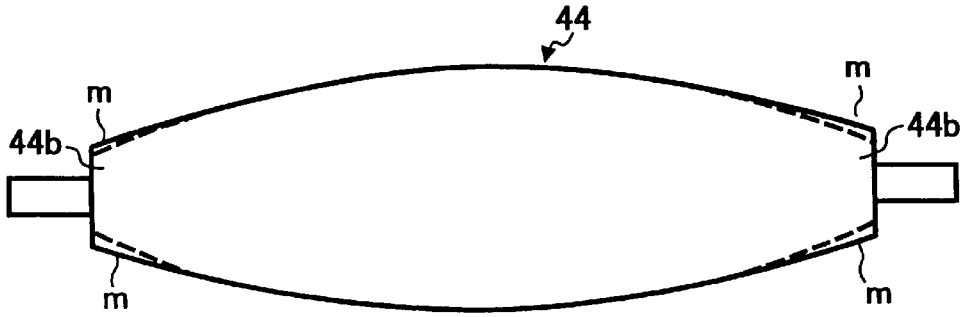

Further, it is also preferable to use another curve of slightly greater size as both ends of the curve A so as to make the outer diameter D extend at the end portions 44*b* along a curve which is made of this other curve and the curve A. For example, as shown in FIG. 21, side portions m of another quadric curve of slightly greater size are used as both ends of the curve A to make a different curve and, as a result, the outer diameter D is extended at the end portions according to the side portions m which is included in this different curve, as shown in FIG. 22.

Figure 23:
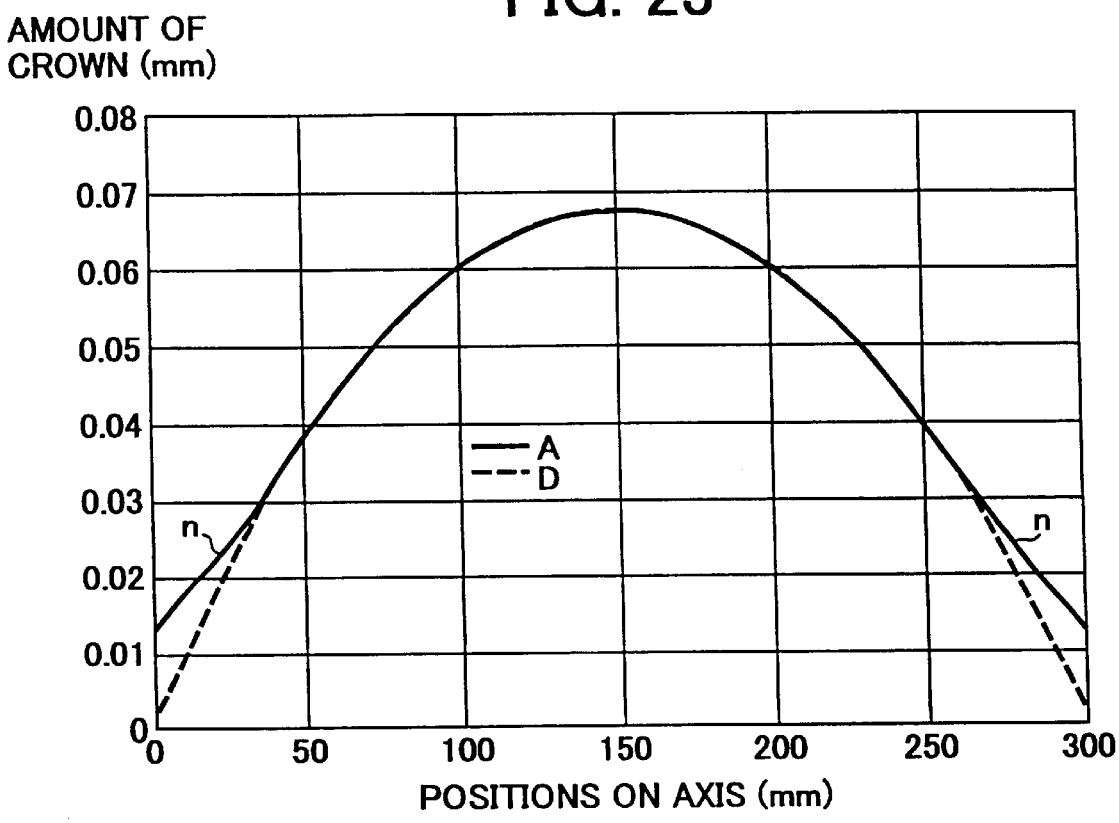
FIGS. 23 and 24 are a graph and an illustration for explaining further different shapes of the development agent regulating member.
Figure 24:
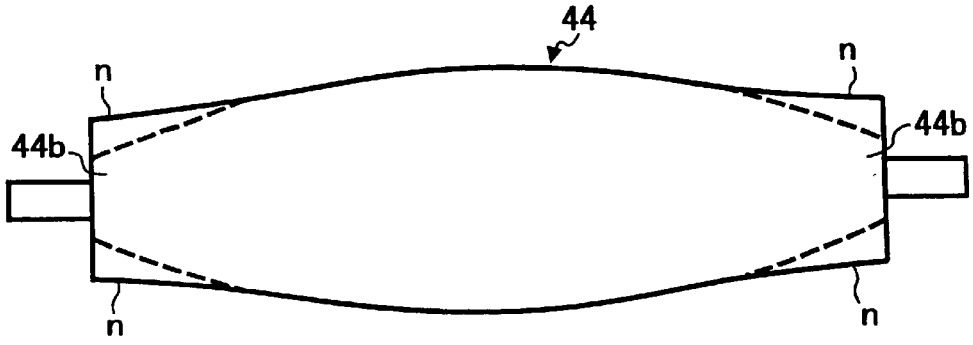

FIG. 23 shows another example in which side portions n are the parts of curves upside down, that is, curves in an inverted position, and these side portions n are used as both ends of the curve A so as to make a different curve E. The outer diameter D is extended around the end portions 44*b* according to the above different curve E, as shown in FIG. 24.

In the above examples, as shown in FIG. 7, the shaft 45 of the development agent regulating member 44 is supported by the development case 24 via the supporting member 46 and the supporting members 46 are pressed by the pressing members 47 so that the supporting members 46 are pressed against the development agent carrying member 25. However, in a case in which the development agent regulating member 44 is held on the development agent carrying member 25 without being pressed by the pressing members 47 but using its own weight, the development agent regulating member 44 may be bent. The present application can be applied also to such a case.

In addition, the present application can also be applied to a mono-color image forming apparatus, a two-color image forming apparatus, and the like, although the examples described above relate to a color laser printer.

Figure 25:
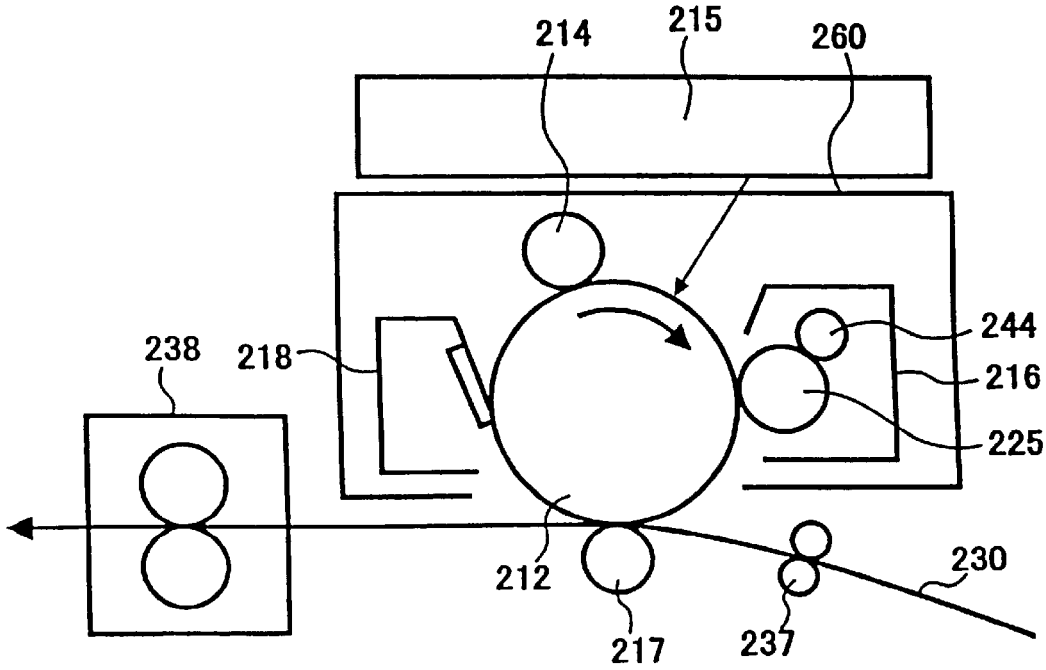
FIG. 25 is an illustration for explaining an image forming apparatus according to the present application.
Figure 26:
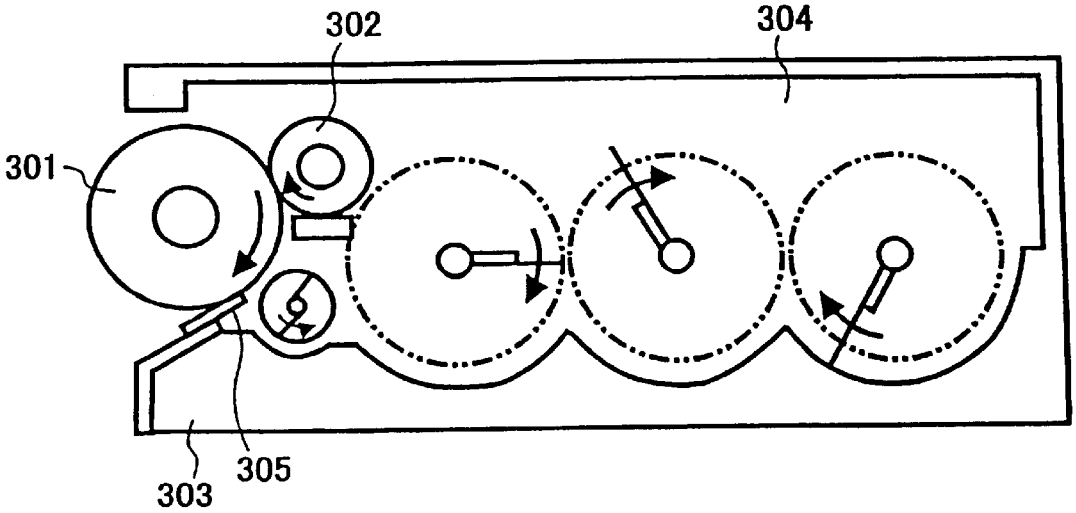
FIG. 26 BACKGROUND ART
FIG. 26 is an illustration of a prior art development apparatus that uses a single component development agent.
Figure 27:
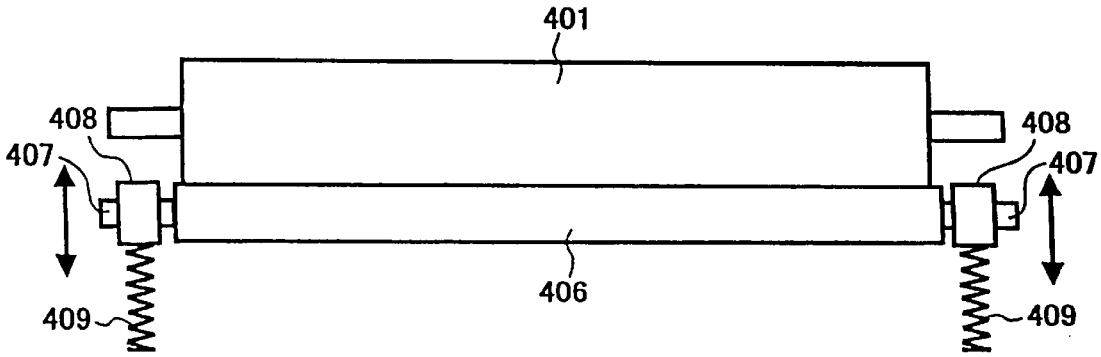
FIG. 27 BACKGROUND ART
FIGS. 27 and 28 are illustrations of a prior art development apparatus that uses a roller-shaped development agent regulating member.
Figure 28:
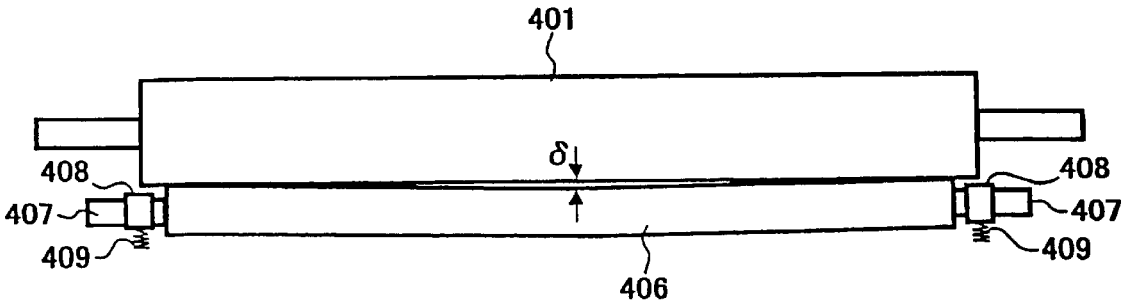
FIG. 28 BACKGROUND ART
Figure 29:
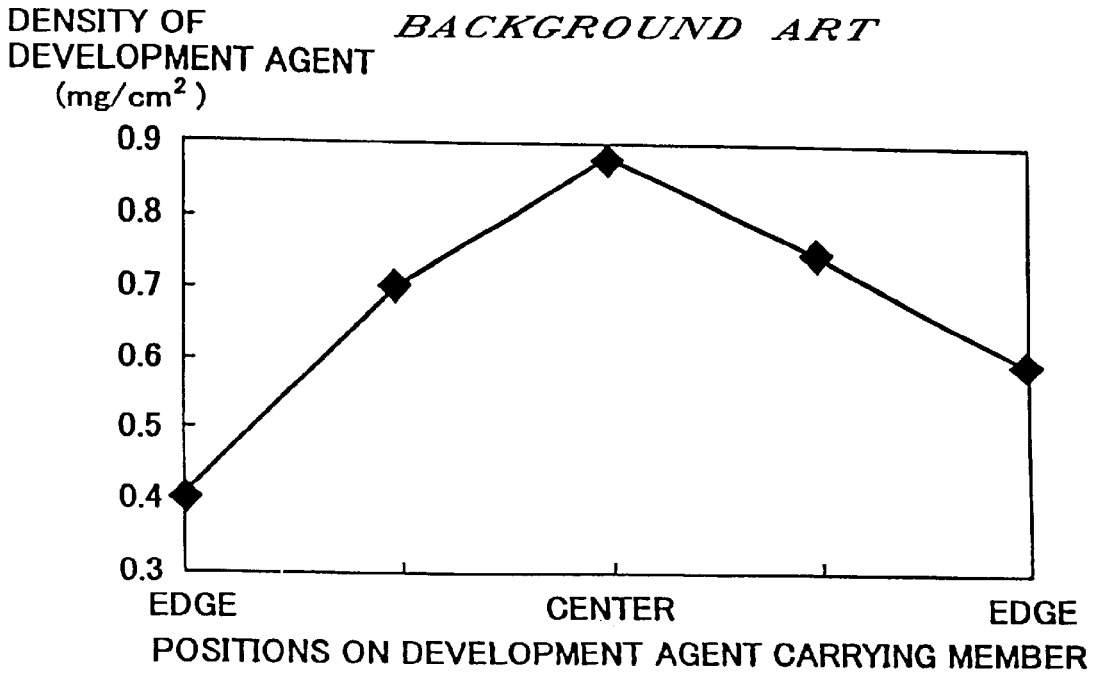
FIG. 29 BACKGROUND ART
FIGS. 29 and 30 are graphs demonstrating relationships between the density of the development agent and the charge on the development agent respectively, and a position on the development agent carrying member in the axial direction, for the prior art apparatus of FIGS. 27 and 28.
Figure 30:
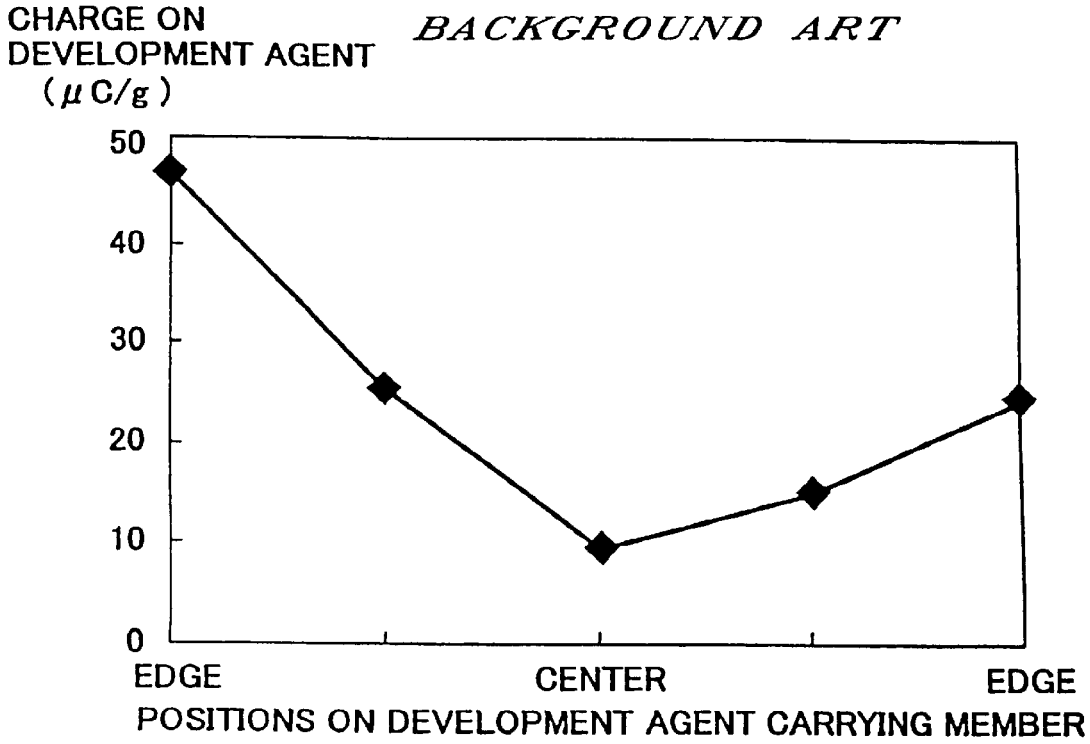
FIG. 30 BACKGROUND ART

For example, the present application can be applied to an image forming apparatus that has a structure in which, as shown in FIG. 25, a charging unit 214, a writing unit 215, a development unit 216, a transferring unit 217, and a cleaning unit 218 are arranged around a drum-like-shaped image carrying member 212. In this image forming apparatus, the image carrying member 212, the charging unit 214, the development unit 216, and the cleaning unit 218 are assembled into a process cartridge 260 which is detachably mounted in the apparatus so that the whole component can easily be exchanged at a time.

In FIG. 25, reference numeral 225 denotes a roller-like-shaped development agent carrying member, reference numeral 244 denotes a roller-like-shaped development agent regulating member, reference numeral 230 denotes a recording sheet, reference numeral 237 denotes a registration roller, and reference numeral 238 denotes a fixing unit.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent applications, No. JPAP2000-169993 filed on Jun. 7, 2000 and No. JPAP2000-290152 filed on Sep. 25, 2000 in the Japanese Patent Office, the entire contents of which are incorporated by reference herein.

What is claimed as new and is desired to be secured by Letters Patent of the United States is:

1. A development agent layer regulator to be used with a first member for carrying a development agent and a second member, in contact with said first member, for supplying the development agent to said first member, comprising:

a roller configured to contact said first member and to regulate a thin film of said development agent on said first member, said roller having a center portion and opposed end portions, said roller having a diameter at said center portion thereof greater than a diameter at said opposed end portions thereof, and said roller having a symmetrical shape about a center line perpendicular to an axis thereof.

2. A development apparatus, comprising:

a first member for carrying a development agent;

a second member, in contact with said first member, for supplying the development agent to said first member; and a roller configured to contact said first member and to regulate a thin film of said development agent on said first member, said roller having a center portion and opposed end portions, said roller having a diameter at said center portion thereof greater than a diameter at said end portions thereof, and said roller having a symmetrical shape about a center line perpendicular to an axis thereof.

3. A development apparatus as defined in claim 2, wherein a diameter of said roller is linearly reduced from said center line towards said opposed end portions thereof.

4. A development apparatus as defined in claim 2, wherein a diameter of said roller is constant within a predetermined width in said center portion thereof and is linearly reduced from said predetermined width of said center portion thereof towards said opposed end portions.

5. A development apparatus as defined in claim 2, wherein said roller includes an elastic layer.

6. A development apparatus as defined in claim 2, wherein said development agent includes a single component.

7. A development apparatus comprising:

a roller configured to contact a member for carrying a development agent and to form a thin film of said development agent on said member, said roller having a center portion and opposed end portions, said roller having a diameter at said center portion thereof greater than a diameter at said end portions thereof, and said roller having a symmetrical shape about a center line perpendicular to an axis thereof, wherein a length of said roller in an axial direction is divided into a plurality of sections, a diameter of said roller in each section is linearly reduced towards the end portion, slanting line segments are formed by the diameters in said plurality of sections, and angles formed by said slanting line segments relative to the axis of said roller are stepwise reduced towards the end portions.

8. A development apparatus as defined in claim 7, wherein division lines are formed at which a length of said roller is divided into said sections, and the diameters at said division lines are set on a single quadric curve.

9. A development apparatus as defined in claim 7, wherein division lines are formed at which a length of said roller is divided into said sections, and the diameters at said division lines are set on a single circular arc.

10. A development apparatus as defined in claim 7, wherein an intersection point of adjacent slanting line segments among the slanting line segments formed by the diameters in the plurality of sections meets a single circular arc of a predetermined radius.

11. A development apparatus as defined in claim 7, wherein the slanting line segments formed by the diameters in the plurality of sections are tangential to a single quadric curve.

12. A development apparatus as defined in claim 7, wherein the slanting line segments formed by the diameters in the plurality of sections are tangential to a single circular arc.

13. A development apparatus as defined in claim 7, wherein division lines are formed at which a length of said roller is divided into said sections, and more than one of the diameters on said division lines at which the length of said roller is divided are set on a single quadric curve and more than one of the slanting line segments formed by the diameters in the plurality of sections are tangential to a same single quadric curve.

14. A development apparatus as defined in claim 7, wherein division lines are formed at which a length of said roller is divided into said sections, and more than one of the diameters on said division lines at which the length of said roller is divided are set on a single circular art and more than one of the slanting line segments formed by the diameters in the plurality of sections are tangential to a same single circular arc.

15. A development apparatus comprising:

a roller configured to contact a member for carrying a development agent and to form a thin film of said development agent on said member, said roller having a center portion and opposed end portions, said roller having a diameter at said center portion thereof greater than a diameter at said end portions thereof, and said roller having a symmetrical shape about a center line perpendicular to an axis thereof, wherein the diameter of said roller is varied in an axial direction in accordance with a specific curve of a variant to a fourth power.

16. A development apparatus as defined in claim 15, wherein tangential lines of the specific curve are used as line segments for both sides of the specific curve so that the diameter of said roller is made relatively greater at said opposed end portions.

17. A development apparatus as defined in claim 15, wherein opposed end parts of a second curve different from said specific curve and that touches the specific curve are used as line segments for both sides of the specific curve so that the diameter of said roller is made relatively smaller at said opposed end portions of said roller.

18. A development apparatus comprising:

a roller configured to contact a member for carrying a development agent and to form a thin film of said development agent on said member, said roller having a center portion and opposed end portions, said roller having a diameter at said center portion thereof greater than a diameter at said end portions thereof, and said roller having a symmetrical shape about a center line perpendicular to an axis thereof, wherein the diameter of said roller is varied in an axial direction in accordance with a quadric curve.

19. A development apparatus comprising:

a roller configured to contact a member for carrying a development agent and to form a thin film of said development agent on said member, said roller having a center portion and opposed end portions, said roller having a diameter at said center portion thereof greater than a diameter at said end portions thereof, and said roller having a symmetrical shape about a center line perpendicular to an axis thereof, wherein the diameter of said roller is varied in an axial direction in accordance with a circular arc.

20. A process cartridge, comprising:

a development apparatus comprising:

a first member for carrying a development agent;

a second member, in contact with said first member, for supplying the development agent to said first member; and a roller having a center portion and opposed end portions, and configured to have a diameter at said center portion thereof greater than a diameter at said opposed end portions thereof, said roller having a symmetrical shape about a center line perpendicular to an axis thereof, wherein said roller contacts said first member and regulates a thin film of said development agent on said first member, wherein said process cartridge is detachably installable to an image forming apparatus.

21. An apparatus, comprising:

a development apparatus comprising:

a first member for carrying a development agent;

a second member, in contact with said first member, for supplying the development agent to said first member; and a roller having a center portion and opposed end portions, and configured to have a diameter at said center portion thereof greater than a diameter at said opposed end portions thereof, said roller having a symmetrical shape about a center line perpendicular to an axis thereof, wherein said roller contacts said first member and regulates a thin film of said development agent on said first member.

22. A development agent layer regulator to be used with a first member for carrying a development agent and a second member, in contact with said first member, for supplying the development agent to said first member, comprising:

means for contacting said first member and regulating a thin film of said development agent on said first member, said means having a center portion and opposed end portions, said means having a diameter at said center portion thereof greater than a diameter at said opposed end portions thereof and said means having a symmetrical shape about a center line perpendicular to an axis thereof.

23. A development apparatus, comprising:

a first member for carrying a development agent;

a second member, in contact with said first member, for supplying the development agent to said first member; and means for contacting said first member and regulating a thin film of said development agent on said first member, said means having a center portion and opposed end portions, said means having a diameter at said center portion thereof greater than a diameter at said opposed end portions thereof, and said means having a symmetrical shape about a center line perpendicular to an axis thereof.

24. A development apparatus as defined in claim 23, wherein a diameter of said means is linearly reduced from said center portion thereof towards said opposed end portions thereof.

25. A development apparatus as defined in claim 23, wherein a diameter of said means is constant within a predetermined width in said center portion thereof and is linearly reduced from said predetermined width of said center portion thereof towards said opposed end portions.

26. A development apparatus as defined in claim 23, wherein said means includes an elastic layer.

27. A development apparatus as defined in claim 23, wherein said development agent includes a single component.

28. A development apparatus comprising:

means for contacting a member for carrying a development agent and forming a thin film of said development agent on said member, said means having a center portion and opposed end portions, said means having a diameter at said center portion thereof greater than a diameter at said opposed end portions thereof, and said means having a symmetrical shape about a center line perpendicular to an axis thereof, wherein a length of said means in an axial direction is divided into a plurality of sections, a diameter of said means in each section is linearly reduced towards the end portion, slanting line segments are formed by the diameters in said plurality of sections, and angles formed by said slanting line segments relative to the axis of said means are stepwise reduced towards the end portions.

29. A development apparatus as defined in claim 28, wherein division lines are formed at which a length of said means is divided into said sections, and the diameters on said division lines at which the length of said means is divided are set on a single quadric curve.

30. A development apparatus as defined in claim 28, wherein division lines are formed at which a length of said means is divided into said sections, and the diameters on said division lines at which the length of said means is divided are set on a single circular arc.

31. A development apparatus as defined in claim 28, wherein an intersection point of adjacent slanting line segments among the slanting line segments formed by the diameters in the plurality of sections meets a single circular arc of a predetermined radius.

32. A development apparatus as defined in claim 28, wherein the slanting line segments formed by the diameters in the plurality of sections are tangential to a single quadric curve.

33. A development apparatus as defined in claim 28, wherein the slanting line segments formed by the diameters in the plurality of sections are tangential to a single circular arc.

34. A development apparatus as defined in claim 28, wherein division lines are formed at which a length of said means is divided into said sections, and more than one of the diameters on said division lines at which the length of said means is divided are set on a single quadric curve and more than one of the slanting line segments formed by the diameters in the plurality of sections are tangential to a same single quadric curve.

35. A development apparatus as defined in claim 28, wherein division lines are formed at which a length of said means is divided into said sections, and more than one of the diameters on said division lines at which the length of said means is divided are set on a single circular arc and more than one of the slanting line segments formed by the diameters in the plurality of sections are tangential to a same single circular arc.

36. A development apparatus comprising:

means for contacting a member for carrying a development agent and forming a thin film of said development agent on said member, said means having a center portion and opposed end portions, said means having a diameter at said center portion thereof greater than a diameter at said opposed end portions thereof, and said means having a symmetrical shape about a center line perpendicular to an axis thereof, wherein the diameter of said means is varied in an axial direction in accordance with a specific curve of a variant to a fourth power.

37. A development apparatus as defined in claim 36, wherein tangent lines of the specific curve are used as line segments for both sides of the specific curve so that the diameter of said means is made relatively smaller in the both end portions.

38. A development apparatus as defined in claim 36, wherein opposed end parts of a second curve different from said specific curve and that touches the specific curve are used as line segments for both sides of the specific curve so that the diameter of said means is made relatively greater at said opposed end portions of said roller means.

39. A development apparatus comprising:

means for contacting a member for carrying a development agent and forming a thin film of said development agent on said member, said means having a center portion and opposed end portions, said means having a diameter at said center portion thereof greater than a diameter at said opposed end portions thereof, and said means having a symmetrical shape about a center line perpendicular to an axis thereof, wherein the diameter of said means is varied in an axial direction in accordance with a quadric curve.

40. A development apparatus comprising:

means for contacting a member for carrying a development agent and forming a thin film of said development agent on said member, said means having a center portion and opposed end portions, said means having a diameter at said center portion thereof greater than a diameter at said opposed end portions thereof, and said means having a symmetrical shape about a center line perpendicular to an axis thereof.

wherein the diameter of said means is varied in an axial direction in accordance with a circular arc.

41. A process cartridge, comprising:

developing means comprising:

a first member for carrying a development agent;

a second member, in contact with said first member, for supplying the development agent to said first member; and means having a center portion and opposed end portions, for contacting said first member and regulating a thin film of said development agent on said first member, said means having a diameter at said center portion thereof greater than a diameter at said opposed end portions thereof, said means having a symmetrical shape about a center line perpendicular to an axis thereof, wherein said process cartridge is detachably installable into an image forming apparatus.

42. An apparatus, comprising:

developing means comprising:

a first member for carrying a development agent;

a second member, in contact with said first member, for supplying the development agent to said first member; and means for contacting said first member and regulating a thin film of said development agent on said first member, said means having a center portion and opposed end portions, and having a diameter at said center portion thereof greater than a diameter at said opposed end portions thereof, and said means having a symmetrical shape about a center line perpendicular to an axis thereof.

43. A method of regulating a development agent, comprising the steps of:

providing a first member for carrying a development agent;

providing a second member, in contact with said first member, for supplying the development agent to said first member;

providing a roller having a center portion and opposed end portions and having a diameter around a center portion thereof greater than a diameter around end portions thereof and having a symmetrical shape about a center line perpendicular to an axis thereof;

supporting said roller in contact with said first member; and rotating said roller to form a thin film of said development agent on said first member.

44. A method of regulating a development agent, comprising the steps of:

providing a first member for carrying a development agent;

providing a second member, in contact with said first member, for supplying the development agent to said first member; and providing a roller having a center portion and opposed end portions, regulating the development agent on said first member with said roller, and said roller having a diameter at a center portion thereof greater than a diameter at opposed end portions thereof, and having a symmetrical shape about a center line perpendicular to an axis thereof.

45. A method of development, comprising:

providing a first member for carrying a development agent;

providing a second member, in contact with said first member, for supplying the development agent to said first member; and providing a roller having a center portion and opposed end portions, and regulating a development agent on said first member with said roller, and said roller having a diameter at a center portion thereof greater than a diameter at opposed end portions thereof, and having a symmetrical shape about a center line perpendicular to an axis thereof.

46. A method of development as defined in claim 45, wherein a diameter of said roller is linearly reduced from said center portion thereof towards said opposed end portions thereof.

47. A method of development as defined in claim 45, wherein a diameter of said roller is constant within a predetermined width in said center portion thereof and is linearly reduced from said predetermined width of the center portion towards said opposed end portions.

48. A method of development as defined in claim 45, wherein said roller includes an elastic layer.

49. A method of development as defined in claim 45, wherein said development agent includes a single component.

50. A method of development, comprising:

providing a roller having a center portion and opposed end portions, carrying a development agent with said roller, and forming a thin film of said development agent on said roller, said roller having a diameter at a center portion thereof greater than a diameter at opposed end portions thereof, and having a symmetrical shape about a center line perpendicular to an axis thereof, wherein a length of said roller in an axial direction is divided into a plurality of sections, a diameter of said roller in each section is linearly reduced towards the end portion, slanting line segments are formed by the diameters in said plurality of sections, and angles formed by said slanting line segments relative to the axis of said roller are stepwise reduced towards the end portions.

51. A method of development as defined in claim 50, wherein division lines are formed at which a length of said roller is divided into sections, and the diameters at said division lines are set on a single quadric curve.

52. A method of development as defined in claim 50, wherein division lines are formed at which a length of said roller is divided into sections, and the diameters at said division lines are set on a single circular arc.

53. A method of development as defined in claim 50, wherein an intersection point of adjacent slanting line segments among the slanting line segments formed by the diameters in the plurality of sections meets a single circular arc of a predetermined radius.

54. A method of development as defined in claim 50, wherein the slanting line segments formed by the diameters in the plurality of sections are tangential to a single quadric curve.

55. A method of development as defined in claim 50, wherein the slanting line segments formed by the diameters in the plurality of sections are tangential to a single circular arc.

56. A method of development as defined in claim 50, wherein division lines are formed at which a length of said roller is divided into sections, more than one of the diameters at said division lines are set on a single quadric curve, and more than one of the slanting line segments formed by the diameters in the plurality of sections are tangential to the same single quadric curve.

57. A method of development as defined in claim 50, wherein division lines are formed at which a length of said roller is divided into sections, more than one of the diameters at said division lines at which the length of said roller is divided are set on a single circular arc and more than one of the slanting line segments formed by the diameters in the plurality of sections are tangential to the same single circular arc.

58. A method of development, comprising:

providing a roller having a center portion and opposed end portions, carrying a development agent with said roller, and forming a thin film of said development agent on said roller, said roller having a diameter at a center portion thereof greater than a diameter at opposed end portions thereof, and having a symmetrical shape about a center line perpendicular to an axis thereof, wherein the diameter of said roller is varied in an axial direction in accordance with a specific curve of a variant to a fourth power.

59. A method of development as defined in claim 58, wherein tangential lines of the specific curve are used as line segments for both sides of the specific curve so that the diameter of said roller is made relatively smaller at said opposed end portions.

60. A method of development as defined in claim 58, wherein opposed end parts of a second curve different from said specific curve and that touches the specific curve are used as line segments for both sides of the specific curve so that the diameter of said roller is made relatively smaller at said opposed end portions.

61. A method of development, comprising:

providing a roller having a center portion and opposed end portions, carrying a development agent with said roller, and forming a thin film of said development agent on said roller, said roller having a diameter at a center portion thereof greater than a diameter at opposed end portions thereof, and having a symmetrical shape about a center line perpendicular to an axis thereof, wherein the diameter of said roller is varied in an axial direction in accordance with a quadric curve.

62. A method of development, comprising:

providing a roller having a center portion and opposed end portions, carrying a development agent with said roller, and forming a thin film of said development agent on said roller, said roller having a diameter at a center portion thereof greater than a diameter at opposed end portions thereof, and having a symmetrical shape about a center line perpendicular to an axis thereof, wherein the diameter of said roller is varied in an axial direction in accordance with a circular arc.

63. A method of forming an image, comprising the steps of:

providing a first member for carrying a development agent;

providing a second member, in contact with said first member, for supplying the development agent to said first member;

providing a roller having a center portion and opposed end portions, and regulating a development agent on said first member with said roller, said roller having a diameter at a center portion thereof greater than a diameter at opposed end portions thereof, and having a symmetrical shape about a center line perpendicular to an axis, thereof.

* * * * *